US009475178B2

(12) United States Patent
Pelletier et al.

(10) Patent No.: US 9,475,178 B2
(45) Date of Patent: Oct. 25, 2016

(54) ADJUSTABLE RATCHETING SOCKET WRENCH

(71) Applicant: STANLEY BLACK & DECKER, INC., New Britain, CT (US)

(72) Inventors: Thomas Pelletier, Wallingford, CT (US); Heather Li, Middletown, CT (US)

(73) Assignee: STANLEY BLACK & DECKER, INC., New Britain, CT (US)

( * ) Notice: Subject to any disclaimer, the term of this patent is extended or adjusted under 35 U.S.C. 154(b) by 541 days.

(21) Appl. No.: 13/961,622

(22) Filed: Aug. 7, 2013

(65) Prior Publication Data

US 2014/0109730 A1 Apr. 24, 2014

Related U.S. Application Data

(60) Provisional application No. 61/717,301, filed on Oct. 23, 2012.

(51) Int. Cl.
*B25B 13/46* (2006.01)
*B25B 13/44* (2006.01)

(52) U.S. Cl.
CPC ..... *B25B 13/463* (2013.01); *B25B 13/44* (2013.01); *B25B 13/461* (2013.01)

(58) Field of Classification Search
CPC ... B25B 13/463; B25B 13/465; B25B 13/04; B25B 13/461; B25B 13/462; B25B 13/468; B25B 13/481; B25B 13/467; B25B 13/44; B25B 1/02
See application file for complete search history.

(56) References Cited

U.S. PATENT DOCUMENTS

| | | | | | |
|---|---|---|---|---|---|
| 1,467,735 | A * | 9/1923 | Morgan | B25B 13/44 | 279/36 |
| 2,582,444 | A | 1/1952 | Lucht | | |
| 3,052,906 | A * | 9/1962 | Shiffman | G04D 3/067 | 15/105 |
| 4,608,887 | A | 9/1986 | Colvin | | |
| 4,663,999 | A | 5/1987 | Colvin | | |
| 4,781,084 | A * | 11/1988 | Steen | B25B 27/0042 | 81/111 |
| 4,884,480 | A | 12/1989 | Briese | | |
| 5,144,869 | A * | 9/1992 | Chow | B25B 13/463 | 81/63 |
| 6,308,594 | B1 * | 10/2001 | Cheng | B25B 13/463 | 81/62 |
| 7,707,916 | B2 * | 5/2010 | Pirseyedi | B25B 13/44 | 279/64 |
| 2004/0139827 | A1 * | 7/2004 | Micklich | B25B 13/06 | 81/124.3 |
| 2007/0193418 | A1 * | 8/2007 | Carnesi | B25B 13/44 | 81/128 |
| 2010/0000379 | A1 * | 1/2010 | Hsu Chang | B25B 13/06 | 81/129 |

* cited by examiner

*Primary Examiner* — Robert Scruggs
(74) *Attorney, Agent, or Firm* — Pillsbury Winthrop Shaw Pittman LLP

(57) ABSTRACT

An adjustable socket that includes a housing, a rotatable member engageable with the housing such that the rotation of the rotatable member causes the housing to move upwardly or downwardly along the longitudinal axis, an adjusting collar engageable with the rotatable member and the housing, a plurality of jaws, a retainer, and a lock member. Each jaw is received in a corresponding one of apertures of the housing. The lock member is operatively connected with the rotatable member and is constructed and arranged to secure the adjusting collar to the housing and the plurality of jaws. The jaws are movable towards and away from the longitudinal axis of the housing through a range of positions upon the rotation of the rotatable member.

20 Claims, 21 Drawing Sheets

ADJUSTABLE RATCHETING SOCKET WRENCH

This application claims priority and benefit under 35 U.S.C. §119(e) to U.S. Provisional Patent Application Ser. No. 61/717,301, filed Oct. 23, 2012. The content of that application is incorporated herein in its entirety by reference.

BACKGROUND

Field

The present patent application relates to an adjustable socket that can be used with a ratcheting wrench.

An adjustable socket can be a convenient alternative to a set of individual fixed-size non-adjustable sockets. A single adjustable socket can be adjusted to fit fasteners (e.g. nuts, bolts, etc.) of different sizes, whereas individual fixed-size sockets must be selected from a socket set to fit fasteners of different sizes. Some adjustable sockets can also grip a worn fastener more firmly than a fixed-size socket selected from a socket set. Conversely, an adjustable socket having worn jaws can grip a fastener more firmly than a worn fixed-size socket selected from a socket set.

The present patent application provides improvements over the prior adjusting sockets, and combines an adjustable socket with a ratcheting wrench.

SUMMARY

One aspect of the present patent application provides an adjustable socket that includes a housing having a longitudinal axis, the housing having a plurality of apertures extending therethrough; a rotatable member engageable with the housing such that the rotation of the rotatable member causes the housing to move upwardly or downwardly along the longitudinal axis; an adjusting collar engageable with the rotatable member and the housing, the adjusting collar having a beveled surface; a plurality of jaws, each jaw being received in a corresponding one of the apertures, each jaw having: an inward face facing towards the longitudinal axis of the housing; a beveled outward face facing away from the longitudinal axis of the housing, the beveled outward face being slidable on the beveled surface of the adjusting collar; and a biasing element biasing said each jaw away from the longitudinal axis of the housing; a retainer having a flange supportable by the housing and a protrusion extending from the flange between the jaws' inward faces, each biasing element extending between the protrusion and a corresponding one of the jaws; and a lock member operatively connected with the rotatable member and constructed and arranged to secure the adjusting collar to the housing and the plurality of jaws. The jaws are movable towards and away from the longitudinal axis of the housing through a range of positions upon the rotation of the rotatable member.

Another aspect of the present patent application provides an adjustable ratchet socket wrench that includes a body; a handle portion; at least one pawl arrangement disposed in the body; and at least one adjustable socket. The at least one an adjustable socket includes a housing having a longitudinal axis, the housing having a plurality of apertures extending therethrough; a rotatable member engageable with the housing such that the rotation of the rotatable member causes the housing to move upwardly or downwardly along the longitudinal axis; an adjusting collar engageable with the rotatable member and the housing, the adjusting collar having a beveled surface; a plurality of jaws, each jaw being received in a corresponding one of the apertures, each jaw having: an inward face facing towards the longitudinal axis of the housing; a beveled outward face facing away from the longitudinal axis of the housing, the beveled outward face being slidable on the beveled surface of the adjusting collar; and a biasing element biasing said each jaw away from the longitudinal axis of the housing; a retainer having a flange supportable by the housing and a protrusion extending from the flange between the jaws' inward faces, each biasing element extending between the protrusion and a corresponding one of the jaws; and a lock member operatively connected with the rotatable member and constructed and arranged to secure the adjusting collar to the housing and the plurality of jaws. The jaws are movable towards and away from the longitudinal axis of the housing through a range of positions upon the rotation of the rotatable member. The adjusting collar having gear teeth disposed on an external surface portion thereon. The gear teeth on the adjusting collar are constructed and arranged to engage with a pawl of the at least one pawl arrangement so as to allow the adjustable socket to ratchet in either clockwise or counterclockwise direction.

These and other aspects of the present patent application, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not a limitation of the present patent application. In addition, it should be appreciated that structural features shown or described in any one embodiment herein can be used in other embodiments as well. As used in the specification and in the claims, the singular form of "a", "an", and "the" include plural referents unless the context clearly dictates otherwise.

DETAILED DESCRIPTION

The present patent application pertains to the field of adjustable sockets, more specifically, the present patent application discloses an adjustable socket that can be used with a ratcheting wrench.

Figure 1:
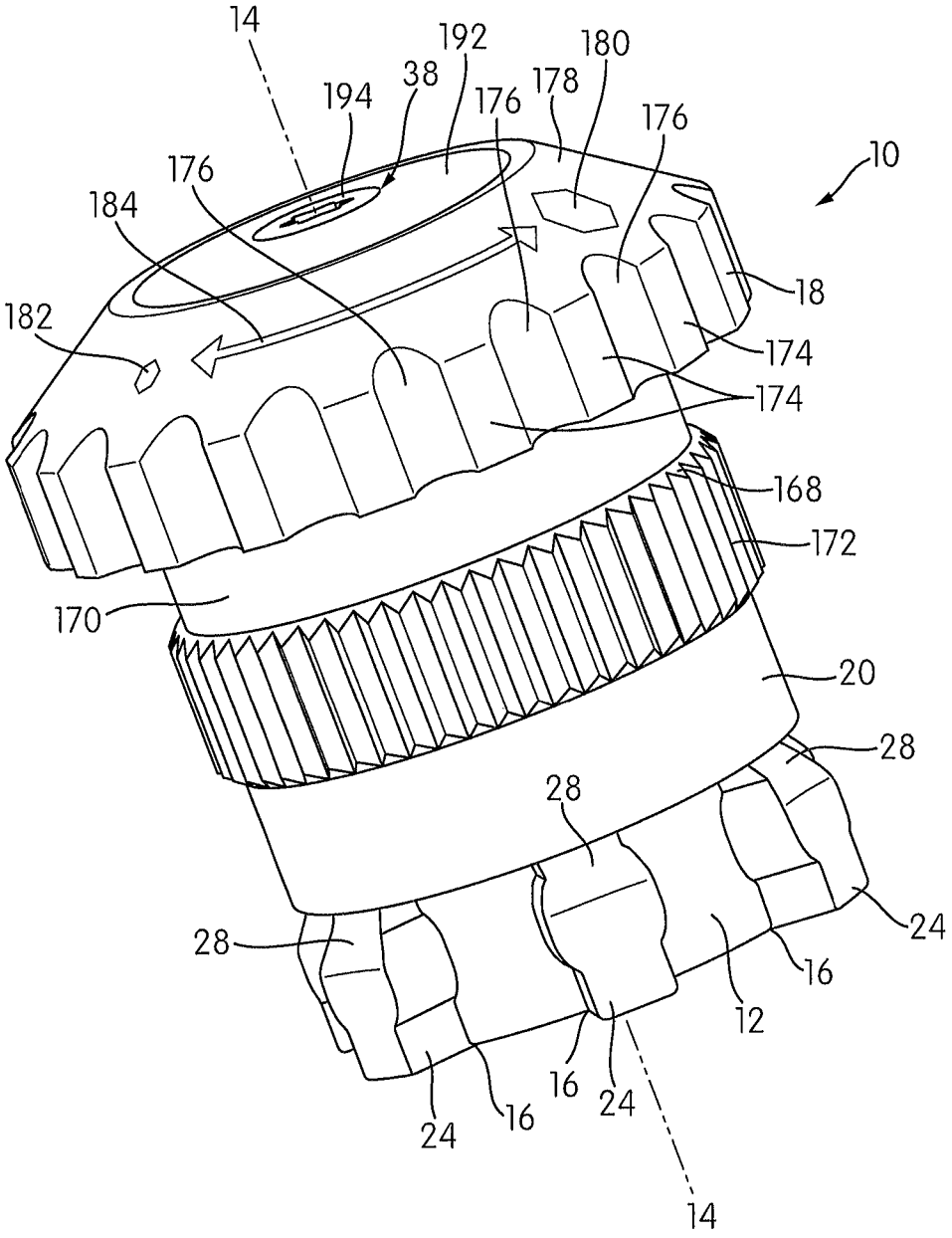
FIG. 1 shows a perspective view of an exemplary adjustable socket in accordance with an embodiment of the present patent application.
Figure 2:
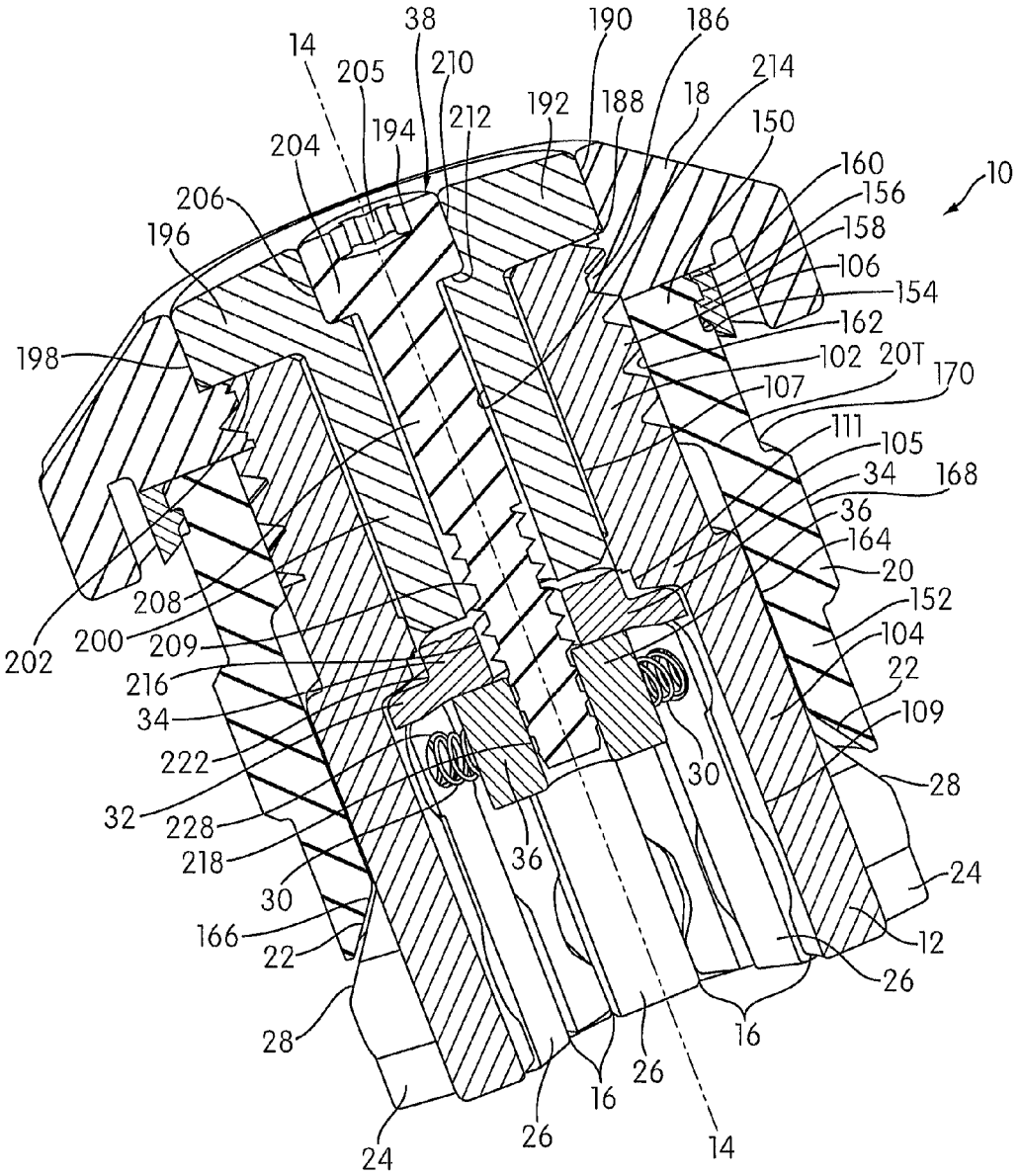
FIG. 2 shows a cross-sectional view of the adjustable socket in accordance with an embodiment of the present patent application.
Figure 3:
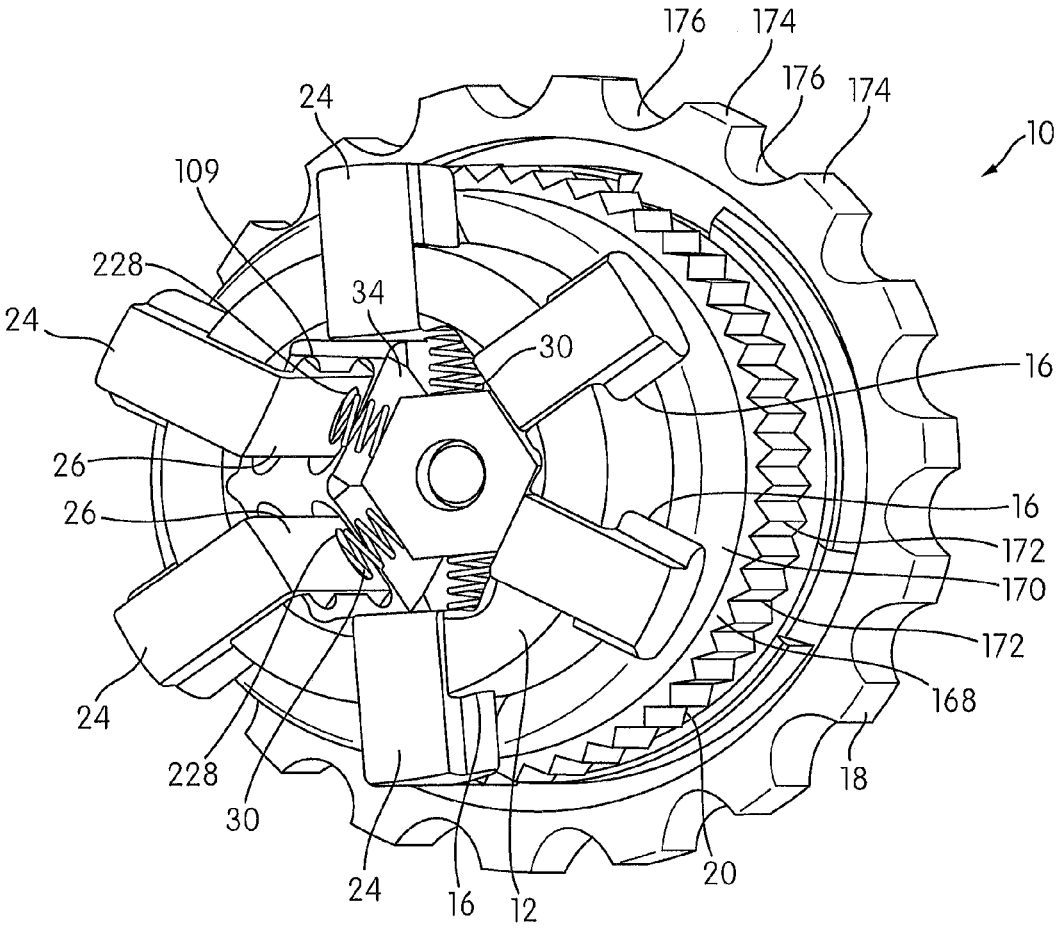
FIG. 3 shows a bottom perspective view of the adjustable socket in accordance with an embodiment of the present patent application.
Figure 4:
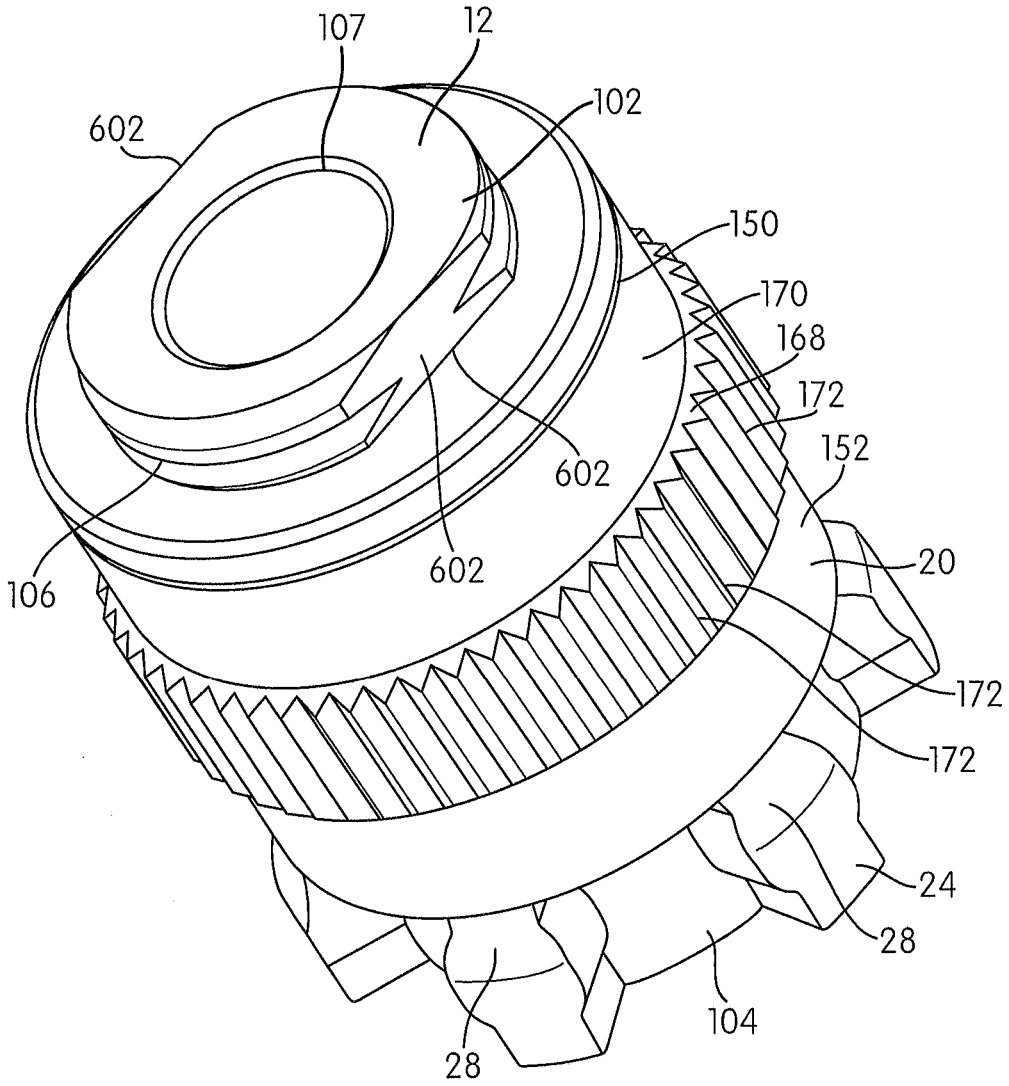
FIG. 4 shows a side perspective view of the adjustable socket, with some of its components removed for the sake of clarity, in accordance with an embodiment of the present patent application.

FIGS. 1-4 show an exemplary adjustable socket 10 in accordance with an embodiment of the present patent application. Specifically, FIG. 1 shows a perspective view of the exemplary adjustable socket 10, while FIGS. 2 and 3 show a cross-sectional view and a bottom perspective view of the adjustable socket 10, respectively, in accordance with an embodiment of the present patent application. FIG. 4 shows a side perspective view of the adjustable socket, with some of its components (e.g., rotatable member and lock member) removed for the sake of clarity, in accordance with an embodiment of the present patent application.

The adjustable socket 10 of the present patent application includes a housing 12 having a longitudinal axis 14 (as shown in FIGS. 1 and 2). The housing 12 includes a plurality of apertures 16 extending therethrough. A rotatable member 18 is engageable with the housing 12 such that the rotation of the rotatable member 18 causes the housing 12 to move upwardly or downwardly along the longitudinal axis 14, and an adjusting collar 20 is engageable with the rotatable member 18 and the housing 12, the adjusting collar 20 having a beveled surface 22 (as shown in FIG. 2). A plurality of jaws 24 is provided, each jaw 24 being received in a corresponding one of the apertures 16. A retainer 32 has a flange 34 supportable by the housing 12 and a protrusion 36 extending from the flange 34 between jaws' inward faces 26 (as shown in FIGS. 2 and 3), each biasing element 30 (as shown in FIGS. 2 and 3) extending between the protrusion 36 and a corresponding one of the jaws 24. A lock member 38 is operatively connected with the rotatable member 18 and constructed and arranged to secure the adjusting collar 20 to the housing 12 and the plurality of jaws 24. Each jaw 24 includes an inward face 26 facing towards the longitudinal axis 14 of the housing 12, and a beveled outward face 28 (as shown in FIGS. 1, 2 and 4) facing away from the longitudinal axis 14 of the housing 12. The beveled outward face 28 is slidable on the beveled surface 22 of the adjusting collar 20. A biasing element 30 biases each jaw 24 away from the longitudinal axis 14 of the housing 12. The jaws 24 are movable towards and away from the longitudinal axis 14 of the housing 12 through a range of positions upon the rotation of the rotatable member 18.

Referring to FIG. 2, the housing 12 has a generally cylindrical shaped configuration with the longitudinal axis 14. The housing 12 includes an upper portion 102 and a lower portion 104. In one embodiment, the upper portion 102 has a smaller diameter and the lower portion 104 has a larger diameter. A transition portion 105 is disposed intermediate the upper portion 102 and the lower portion 104, and acts to transition the diameter of the housing 12 from the smaller diameter of the upper portion 102 to the slightly larger diameter of the lower portion 104. In one embodiment, the upper portion 102, the lower portion 104 and the transition portion 105 are all integrally formed. In one embodiment, the transition portion 105 is constructed and arranged to act as a stop to prevent the housing 12 from moving upwardly through the top portion 20T of the adjusting collar 20.

In one embodiment, the housing 12 is constructed and arranged only to move upwardly or downwardly along the longitudinal axis 14 and not to rotate about the longitudinal axis 14. In one embodiment, the housing 12 is constructed and arranged to move upwardly or downwardly by flat members or anti-rotation members 602 (as shown in FIG. 4) disposed on the housing 12 and the adjusting collar 20. That is, the flat members or anti-rotation members 602 are constructed and arranged to help navigate the housing 12 to move upwardly or downwardly along the longitudinal axis 14 and to prevent the housing 12 from rotating about the longitudinal axis 14. In one embodiment, the flat members or anti-rotation members 602 are constructed and arranged to maintain proper orientation between the adjusting collar 20 and the housing 12. In one embodiment, the housing 12 rotates about the longitudinal axis 14 when the ratchet mechanism/wrench is being used. That is, when the ratchet mechanism/wrench is being used, the adjusting collar 20 and the housing 12 (holding the jaws 24) are configured to rotate about the longitudinal axis 14.

In one embodiment, a portion 106 of the upper portion 102 of the housing 12 includes a threaded portion. In one embodiment, the threaded portion 106 of the housing 12 is an externally threaded portion. As will be clear from the discussions below, this externally threaded portion 106 of the housing 12 is constructed and arranged to engage with an internally threaded portion 186 of the rotatable member 18 so as to secure the rotatable member 18 to the housing 12.

In one embodiment, the upper portion 102, the lower portion 104 and the transition portion 105 of the housing 12 each include apertures or openings 107, 109 and 111, respectively passing therethrough. As will be clear from the discussions below, these apertures or openings 107, 109 and 111 are constructed and arranged to receive the lock member 38 and/or the retainer 32 therein. In one embodiment, portions of the apertures or openings 109 and 111 that are constructed and arranged to receive the retainer 32 therein generally have a hexagonal-shaped cross-sectional configuration (see FIG. 3). In one embodiment, portions of the aperture or opening 107 that are constructed and arranged to receive the lock member 38 therein generally have a circular-shaped cross-sectional configuration (see FIGS. 2 and 3).

The plurality of apertures 16 extend through a portion of the lower portion 104 of the housing 12. The apertures 16 are circumferentially and equally spaced apart from one another. In one embodiment, six apertures are circumferentially and equally spaced apart from one another. However, the number of apertures can vary significantly in number. In one embodiment, the apertures 16 include pairs of diametrically opposed apertures.

Figure 5:
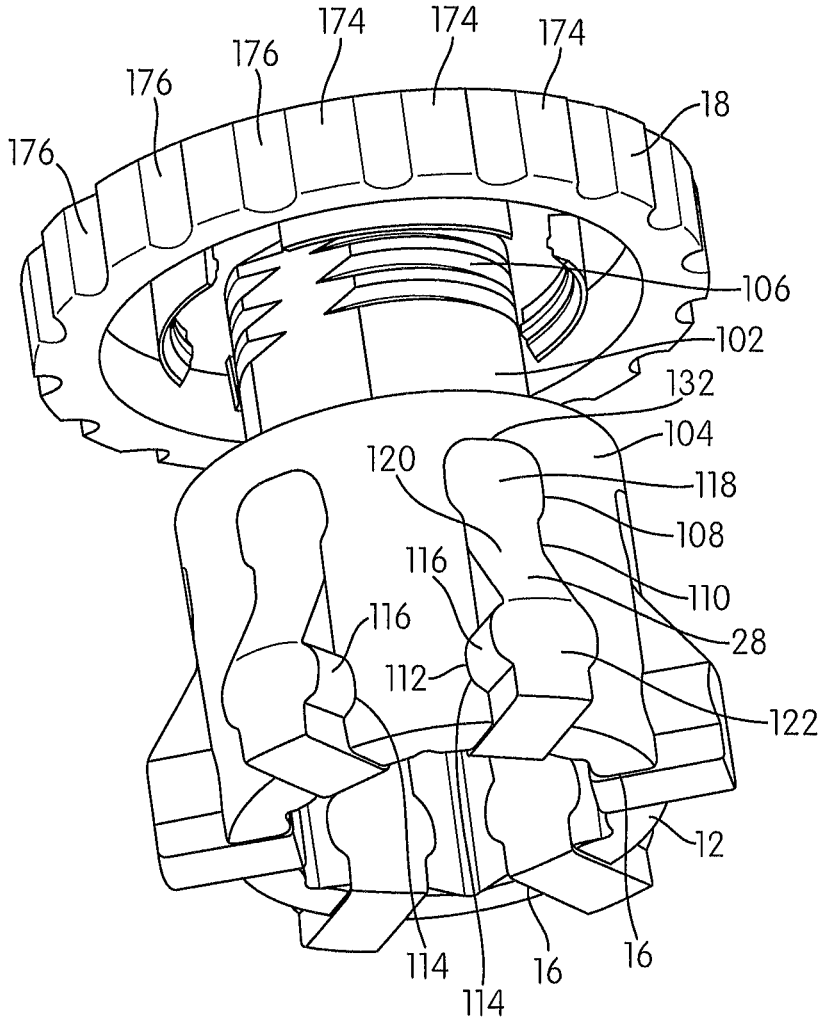
FIG. 5 shows another side perspective view of the adjustable socket, with some of its components removed for the sake of clarity, in accordance with an embodiment of the present patent application.

FIG. 5 shows another side perspective view of the adjustable socket 10, with some of its components (e.g., the adjusting collar 20) removed for the sake of clarity. In one embodiment, referring to FIG. 5, each of the apertures 16 has an upper portion 108, a central portion 110 and a lower portion 112. In one embodiment, the upper portion 108 of the aperture 16 is slightly wider than the central portion 110. The lower portion 112 of each aperture 16 includes a pair of opposing grooves 114. In one embodiment, these opposing grooves 114 are constructed and arranged to receive protrusions 116 of the jaws 24, when the jaw 24 is received in a corresponding one of the apertures 16 so as to secure the jaw 24 in its corresponding aperture 16 and also permit movement of the jaw 24 in its corresponding aperture 16.

Figure 6:
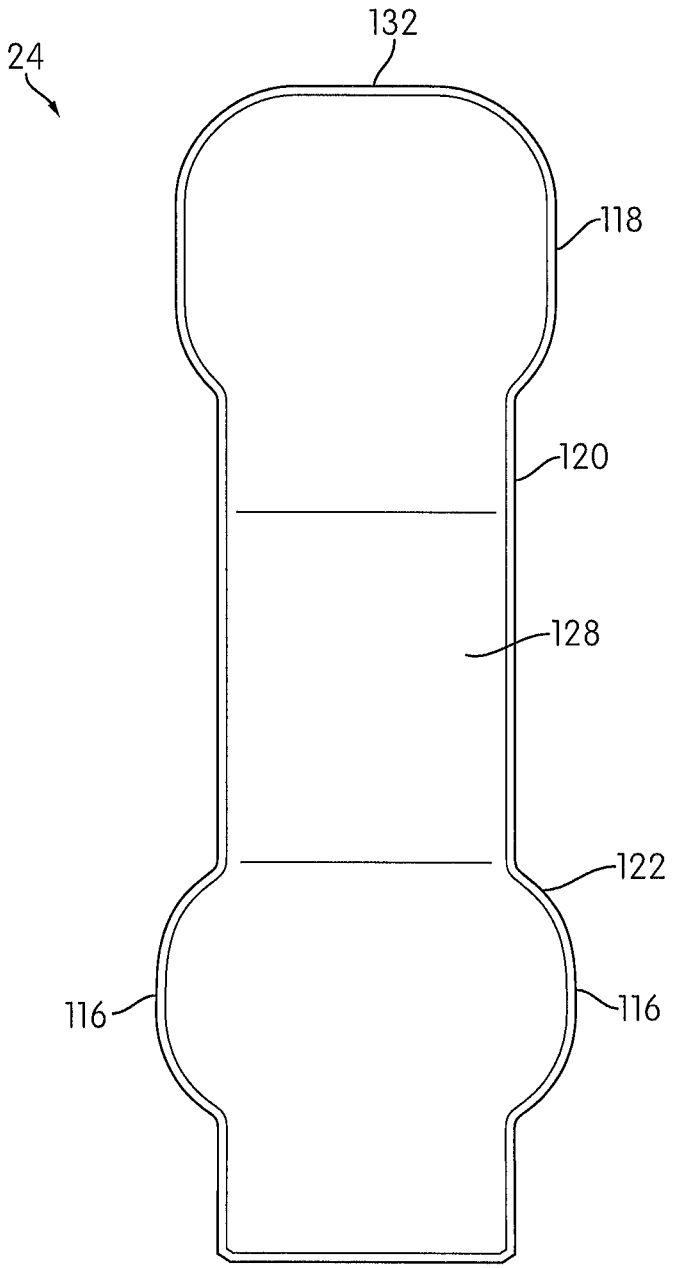
FIG. 6 shows a front view of one of the plurality of jaws of the adjustable socket in accordance with an embodiment of the present patent application.

FIG. 6 shows a front view of one of the plurality of jaws 24 of the adjustable socket 10 in accordance with an embodiment of the present patent application. Referring to FIGS. 5 and 6, each jaw 24 includes an upper portion 118, a central portion 120 and a lower portion 122. These upper, central and lower portions 118, 120 and 122 of the jaw 24 correspond to the upper, central and lower portions 108, 110 and 112 of the corresponding aperture 16. In one embodiment, the upper portion 118 of the jaw 24 is slightly wider than the central portion 120. The lower portion 122 of each jaw 24 includes the pair of opposing protrusions 116. In one embodiment, these opposing protrusions 116 are constructed and arranged to be received in the grooves 114 of the corresponding aperture 16, when the jaw 24 is received in a corresponding one of the apertures 16 of the housing 12 so as to secure the jaw 24 in its corresponding aperture 16 and also permit movement of the jaw 24 in its corresponding aperture 16. That is, each jaw 24 and its corresponding aperture 16 are constructed and arranged such that each jaw 24 is received in the corresponding one of the apertures 16. Also, each jaw 24 and its corresponding aperture 16 are constructed and arranged such that each jaw 24 is slidably movable through the corresponding one of the apertures 16 and each jaw 24 is radially movable in the corresponding one of the apertures 16.

In one embodiment, six jaws 24 are circumferentially, equally spaced apart from one another. However, the number of jaws can vary significantly in number. In one embodiment, the jaws 24 include pairs of diametrically opposed jaws.

In one embodiment, each jaw 24 has the inward face 26 facing towards the longitudinal axis 14, a flat top face 132, and the beveled outward surface 28 that is facing away from the longitudinal axis 14.

Figure 14:
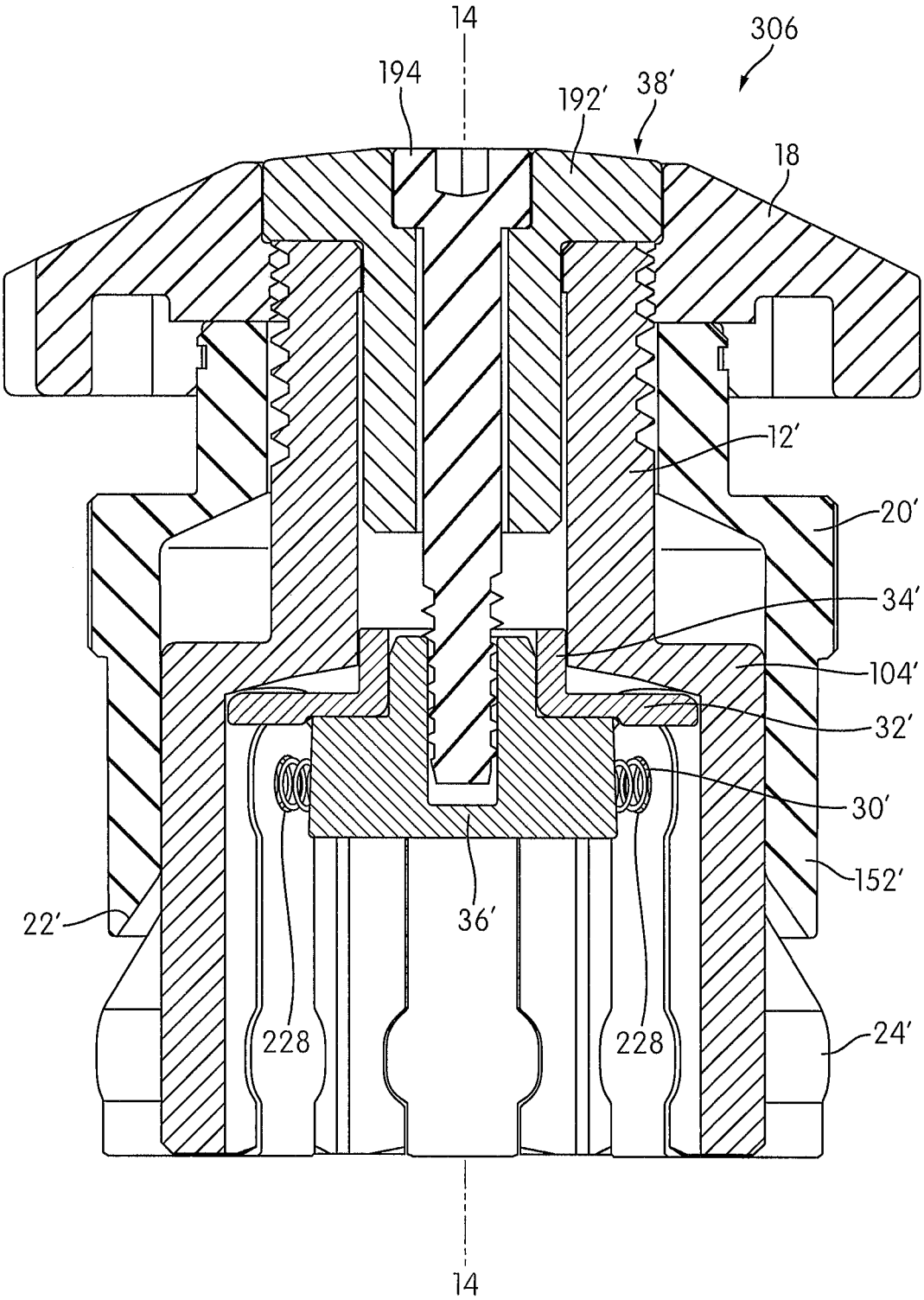
Figure 15:
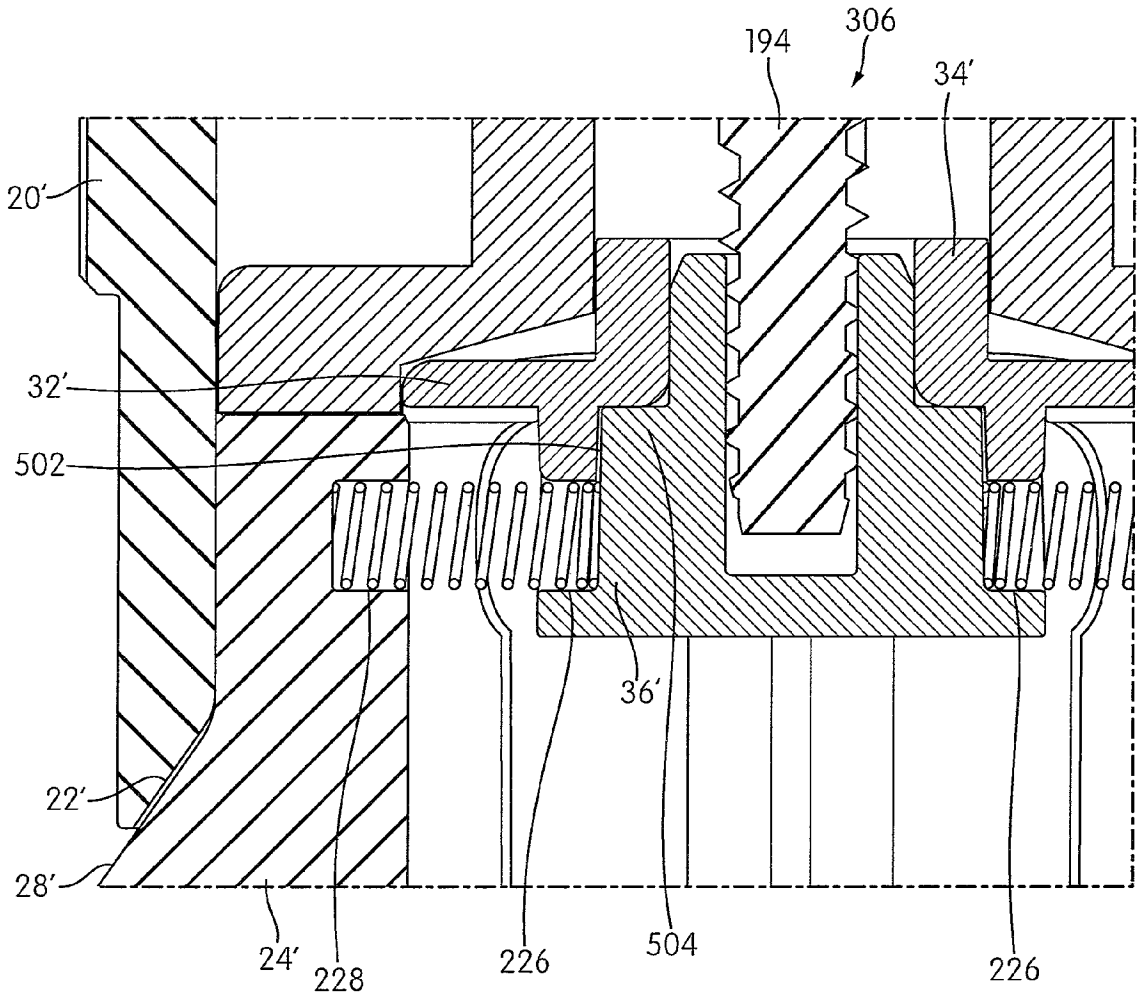
FIG. 15 shows a detailed cross-section view of a portion of the large-sized adjustable socket in accordance with an embodiment of the present patent application.
Figure 16:
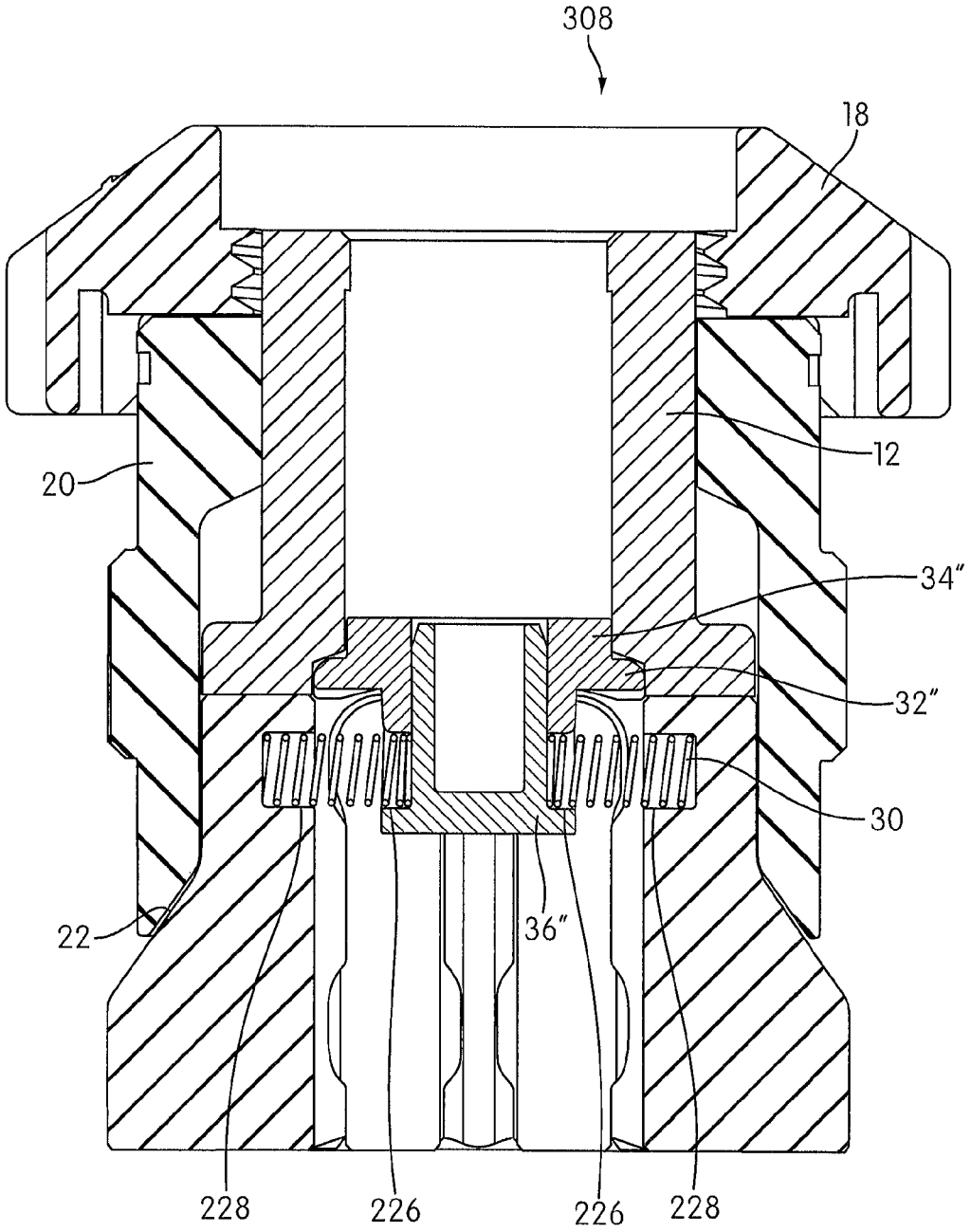
FIGS. 16-18 show cross-section views of the small-sized adjustable socket of the ratcheting wrench, with some of its components removed in FIG. 16 for the sake of clarity, in accordance with an embodiment of the present patent application.
Figure 18:
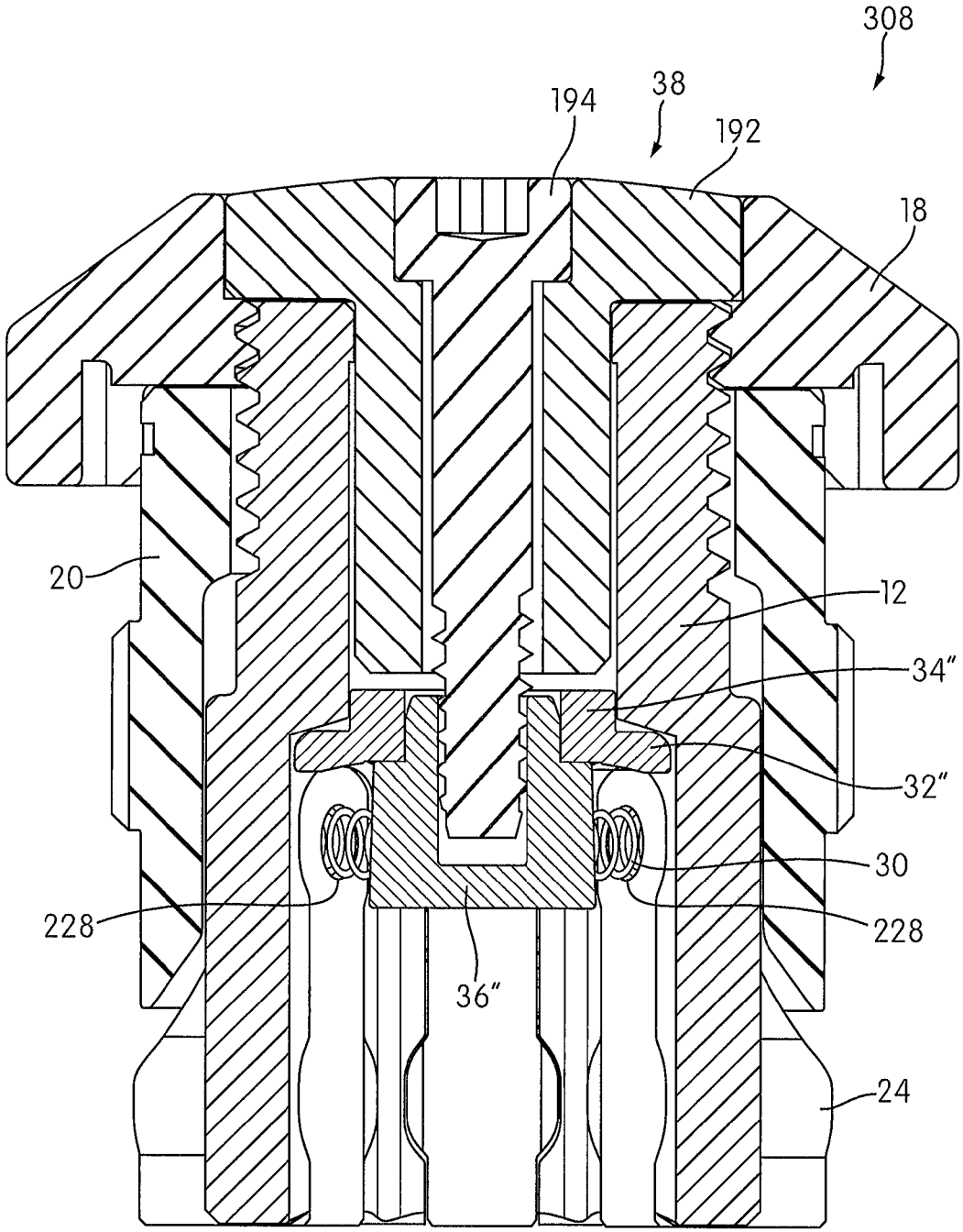
Figure 19:
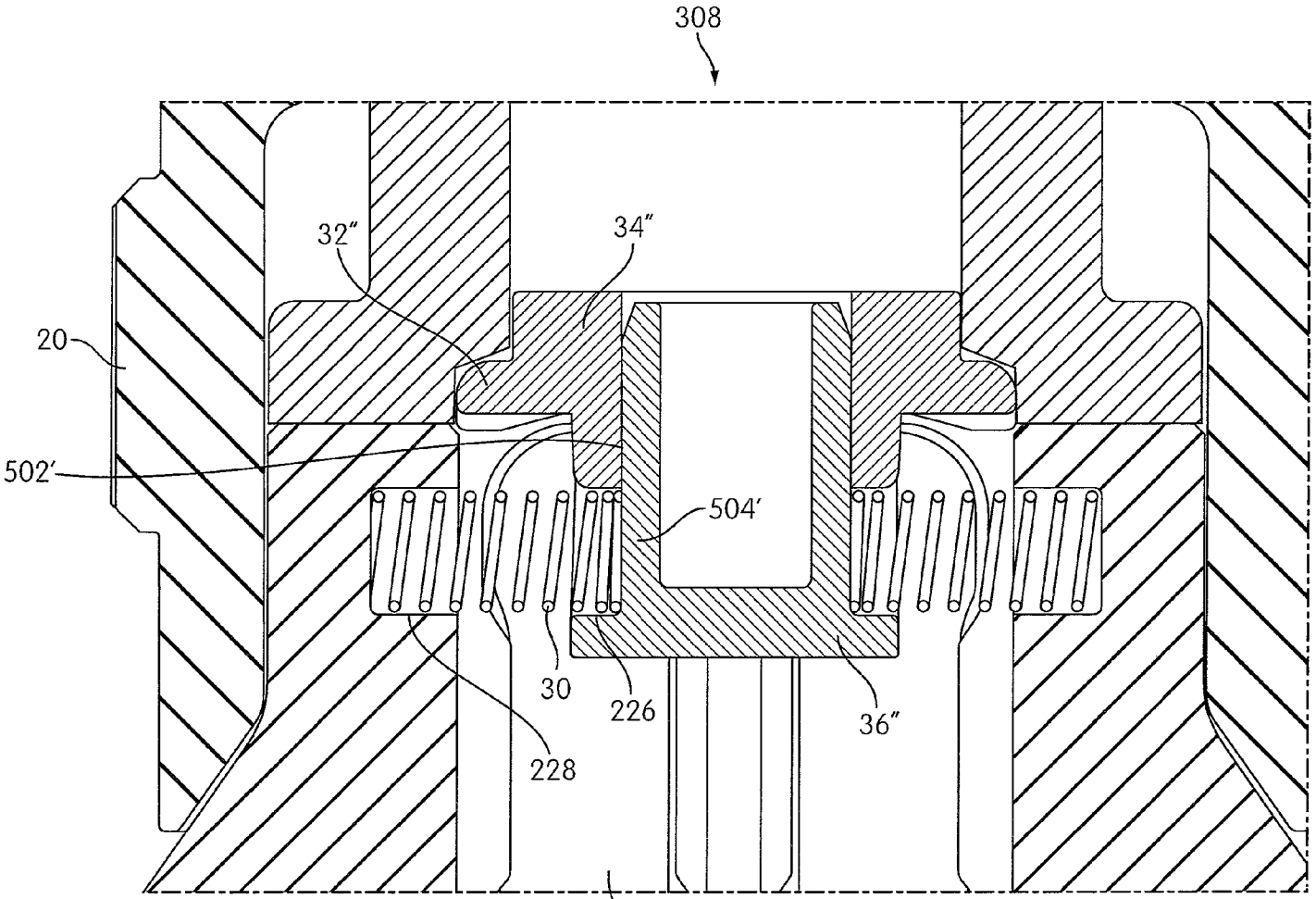
FIG. 19 shows a detailed cross-section view of a portion of the small-sized adjustable socket in accordance with an embodiment of the present patent application.

In one embodiment, the inward face 26 of each jaw 24 includes a recess 228 (as shown in FIGS. 2, 3, 14-16, and 18-19), which has a corresponding recess 226 (as shown in FIGS. 15-16 and 19) formed in the portion 36 of the retainer 32. As will be clear from the discussions below, each biasing element 30 is compressed and fitted between the recess 228 in the jaw 24 and the corresponding recess 226 in the portion 36 of the retainer 32. In one embodiment, the biasing element 30 is a spring.

Referring to FIGS. 2 and 3, the adjusting collar 20 has a generally cylindrical shaped configuration (i.e., circular in cross-section). The adjusting collar 20 includes an upper portion 150 and a lower portion 152. In one embodiment, the upper portion 150 and the lower portion 152 are integrally formed. The upper portion 150 of the adjusting collar 20 includes a circumferential (radially extending) groove 154 disposed on an exterior wall 156 thereof.

The adjusting collar 20 is constructed and arranged only to rotate about the longitudinal axis 14 and not to move upwardly or downwardly along the longitudinal axis 14. The adjusting collar 20 does not rotate with the rotatable member 18 unless the adjusting collar 20 is used via the ratcheting mechanism/wrench. That is, the rotatable member 18 does not cause the adjusting collar 20 to rotate with the rotatable member 18 about the longitudinal axis 14. The adjusting collar 20 only rotates when used on a bolt and/or by hand i.e., when used with the ratcheting mechanism/wrench. The adjusting collar 20 is configured to contain the housing 12 and jaws 24 and to prevent the jaws 24 from falling out of the housing 12.

In one embodiment, the adjusting collar 20 is constructed and arranged to go over the housing 12 and prevent the plurality of jaws 24 from falling out. In one embodiment, the adjusting collar 20 is constructed and arranged to engage with the plurality of jaws 24 and to force the plurality of jaws 24 to move in/out when the adjusting collar 20 and the plurality of jaws 24 contact each other.

The groove 154 is constructed and arranged to engage (e.g., in a snap-fit arrangement) with a circumferential (radially extending) protrusion 158 formed on an interior wall 160 of the rotatable member 18 so as to secure the rotatable member 18 to the adjusting collar 20.

In another embodiment, the connection between the adjusting collar 20 and the rotatable member 18 may be provided using a retaining ring design. For example, an internal retaining ring (not shown) is constructed and arranged to snap over the exterior wall 156, the circumferential protrusion 158 and the interior wall 160 to provide a connection between the adjusting collar 20 and the rotatable member 18.

In one embodiment, the upper portion 150 and the lower portion 152 of the adjusting collar 20 each include apertures or openings 162 and 164, respectively passing therethrough. These apertures or openings 162 and 164 are constructed and arranged to receive portions of the housing 12 therein. In one embodiment, the aperture or opening 162 has a smaller diameter to receive the smaller diameter upper housing portion 102, while the aperture or opening 164 has a slightly larger diameter to receive the larger diameter lower housing portion 104.

The lower portion 152 of the adjusting collar 20 includes the beveled surface 22 circumferentially disposed on an interior surface 166 thereof. The beveled surface 22 of the adjusting collar 20 is constructed and arranged to enable slidable movement of the beveled outward face 28 of the jaw 24 thereon.

Figure 11:
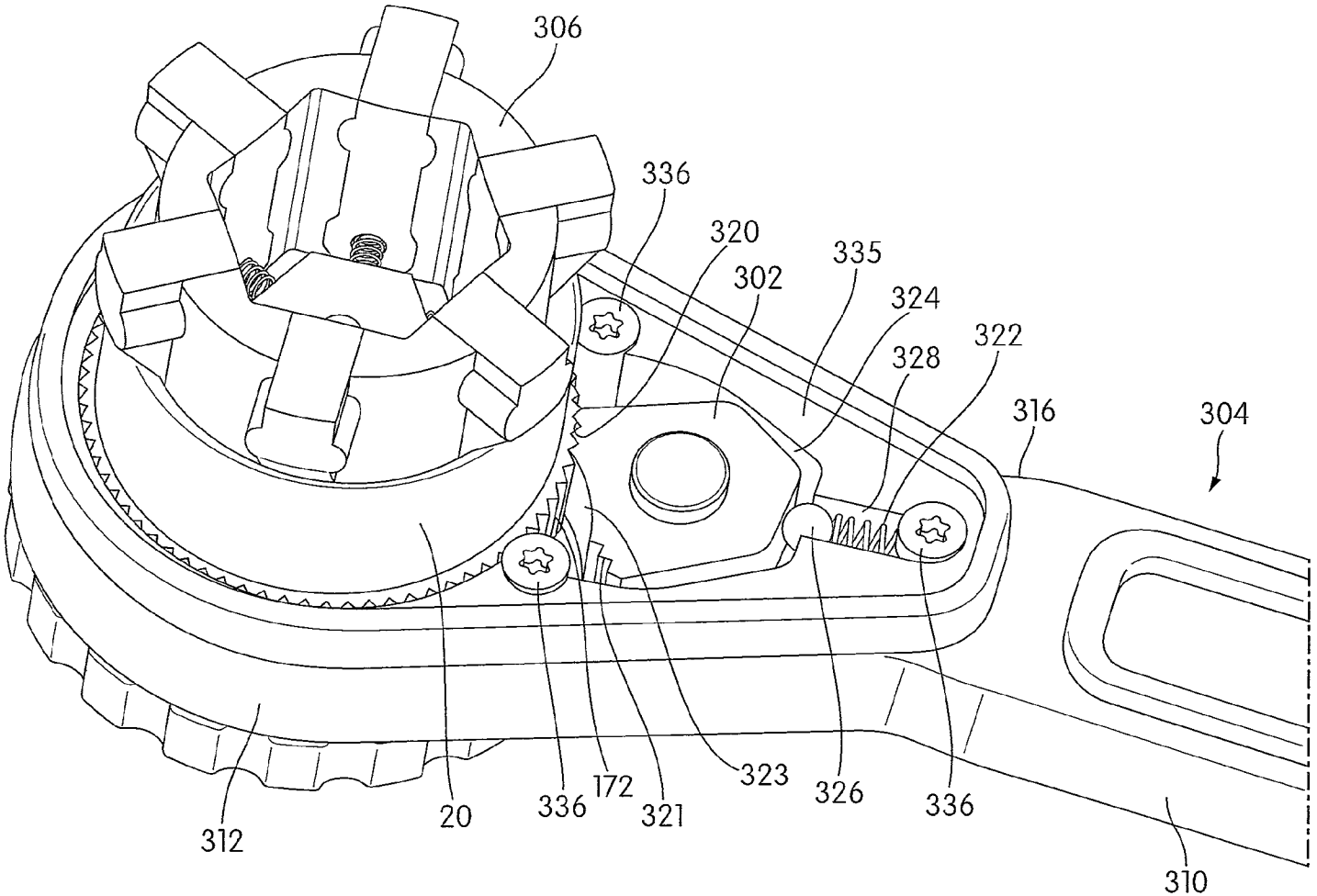
FIG. 11 shows a partial bottom perspective view of the ratcheting wrench and its large-sized adjustable socket, with some of its components removed for the sake of clarity, in accordance with an embodiment of the present patent application.

Referring to FIGS. 2, 3 and 4, the lower portion 152 of the adjusting collar 20 includes a circumferential protruding portion 168 disposed on an exterior surface 170 thereof. The circumferential protruding portion 168 includes gear teeth 172 disposed thereon. As will be clear from the discussions below, the gear teeth 172 on the circumferential protruding portion 168 are constructed and arranged to engage with a pawl 302 of a ratchet wrench/mechanism 304 (as shown in FIG. 11).

Referring to FIGS. 1, 3 and 5, the rotatable member 18 includes projections 174 and grooves 176 (disposed on its exterior surface) which may be formed integrally with the rotatable member 18. The projections 174 and grooves 176 allow rotatable member 18 to be gripped more easily by the user. In particular, the user clamps the rotatable member 18 between his thumb and index finger, and then rotates it. The rotatable member 18 may be rotated clockwise or counter clockwise for some angle of rotation to adjust the socket opening (by opening and closing the jaws 24) from its largest to smallest size (or vice versa). For example, in one exemplary embodiment, when using an M24×2 thread for the rotatable member 18, the range for the degree of rotation is 0° to 1080° (i.e., three full turns of 360°). In other embodiments, the range for degree of rotation is +/−10% of the above-noted range.

In one embodiment, a top surface 178 of the rotatable member 18 includes indicia or markings 180, 182, and 184 provided thereon to provide a visual indication to a user of the rotational direction of the rotatable member 18. The rotatable member 18 is rotated by the user to adjust the size of the socket opening (by opening and closing the jaws 24). The size of the socket opening corresponds to the size of the bolt or nut to be engaged by the adjustable socket 10. In illustrated embodiment as shown in FIG. 1, these indicia or markings may include a large (hexagonal (shown), square or other shapes) bolt head or nut shape 180, a smaller (hexagonal (shown), square or other shapes) bolt head or nut shape 182 and a two-directional arrow 184 positioned between the larger and the smaller shapes 180 and 182. In another embodiment, the words "open" and "close" may be added to the top surface 178 of the rotatable member 18 to provide a visual indication to a user of the rotation direction of the rotatable member 18 to open and close the jaws 24.

Referring to FIG. 2, the rotatable member 18 includes the threaded portion 186 disposed on an internal surface 188 thereof. In one embodiment, the threaded portion 186 of the rotatable member 18 is an internally threaded portion. The internally threaded portion 186 of the rotatable member 18 is constructed and arranged to engage with the externally threaded portion 106 of the housing 12 so as to connect the rotatable member 18 with the housing 12.

In one embodiment, as shown in FIG. 2, the rotatable member 18 includes an aperture or opening 190 passing therethrough. The aperture or opening 190 is constructed and arranged to receive the lock member 38 therein.

Referring to FIGS. 1 and 2, the lock member 38 includes a first member 192 and a second member 194. The first and the second members 192 and 194 of the lock member 38 are constructed and arranged for securing the housing 12, the rotatable member 18, the adjusting collar 20, the retainer 32, and the jaws 24 together in an assembled configuration. In one embodiment, the first and the second members 192 and 194 of the lock member 38 are constructed and arranged to secure the adjusting collar 20 to the plurality of jaws 24.

In one embodiment, the lock member 38 is constructed and arranged to act as a lock to prevent the housing 12 from separating from the adjusting collar 20. For example, in one embodiment, the lock member 38 is constructed and arranged to prevent the housing 12 from moving downwardly (or falling) through the bottom of the adjusting collar 20.

The first member 192 includes a flange portion 196 at an upper end 198 thereof and a generally cylindrical shaped portion 200 protruding downwardly from the center of the flange portion 196. In one embodiment, the portion 200 and the flange portion 196 are integrally formed together. The flange portion 196 of the first member 192 is received in the opening 190 of the rotatable member 18 and is at least partially supported by a top surface 202 of the housing 12. The portion 200 of the first member 192 passes through the opening 107 of the housing 12.

The second member 194 includes a flange portion 204 at an upper end 206 thereof and a generally cylindrical shaped portion 208 protruding downwardly from the center of the flange portion 204. In one embodiment, the portion 208 and the flange portion 204 are integrally formed together. The flange portion 204 of the second member 194 is received in an opening 210 of the first member 192 and is at least partially supported by a surface 212 of the first member 192. The portion 208 of the second member 194 passes through an opening 214 of the first member 192 and openings 216 and 218 of the retainer 32. The second member 194 is in the form of a bolt or screw.

In one embodiment, the flange portion 204 of the second lock member 194 includes a bit engaging groove 205 formed therein. The groove 205 is constructed and arranged to receive driver bits of a driving tool (e.g., a screw driver) thereinto so as to secure the second lock member 194 to the first lock member 192 and the retainer 32.

The second member 194 has a threaded portion 209 disposed on a lower portion of the portion 208. In one embodiment, the threaded portion 209 is constructed and arranged to engage with internal surfaces of the retainer 32 and the portion 200 of the first member 192 so as to secure the housing 12, the rotatable member 18, the adjusting collar 20, the retainer 32, and the jaws 24 together in an assembled configuration.

Figure 20:
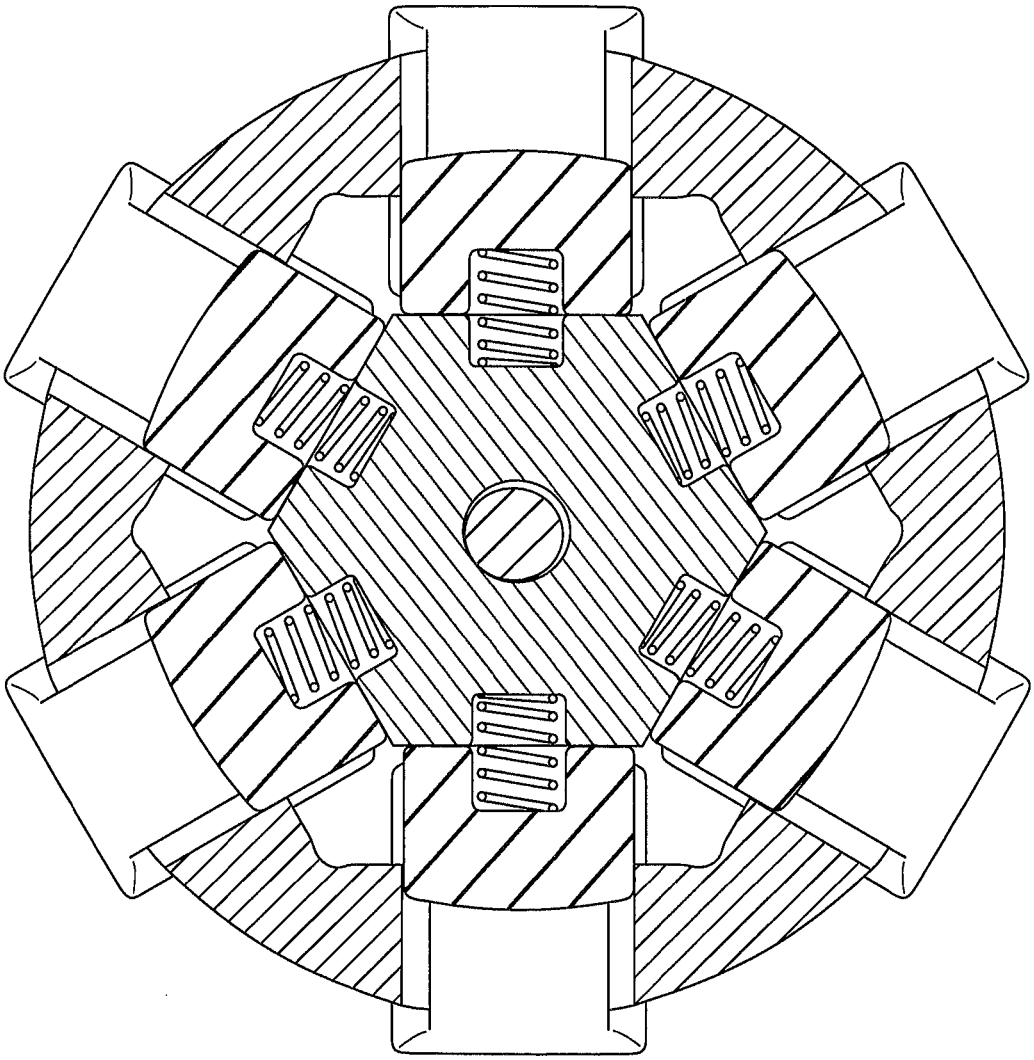
FIG. 20 shows a bottom cross-section view of the large-sized adjustable socket in accordance with an embodiment of the present patent application.
Figure 21:
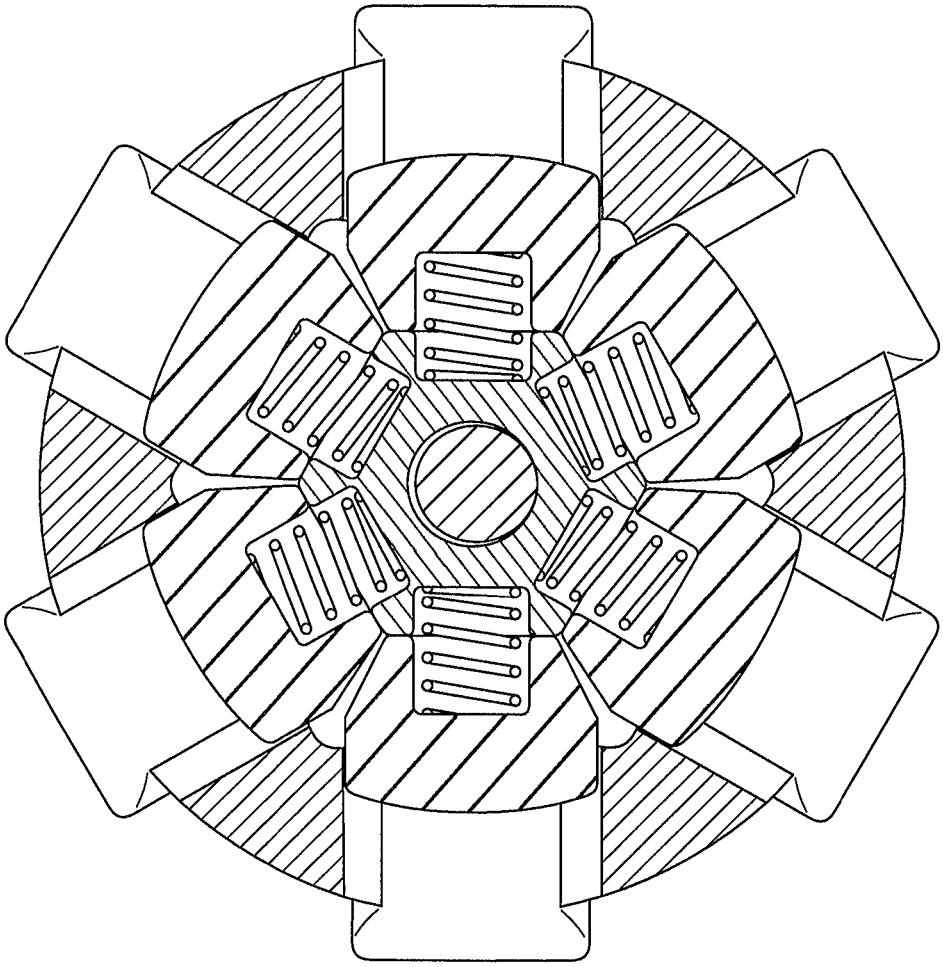
FIG. 21 shows a bottom cross-section view of the small-sized adjustable socket in accordance with an embodiment of the present patent application.

Referring to FIG. 2, the retainer 32 includes the flange portion 34 at an upper end 222 thereof and the generally hexagonal shaped portion 36 protruding downwardly from the center of the flange portion 34. In one embodiment, as shown in FIGS. 20-21, each face of the hexagonal shaped portion 36 is constructed and arranged to at least partially engage with the inward face 26 of each jaw 24.

In one embodiment, the portion 36 and the flange portion 34 are integrally formed together. In another embodiment, the portion 36 and the flange portion 34 are separately formed structures.

In one embodiment, as shown in FIGS. 15-16 and 19, recess 226 is formed in the portion 36. The recess 226 formed in the portion 36 has the corresponding recess 228 formed on the inward face 26 of the jaw 24. Each biasing element 30 (spring) is compressed and fitted between the recess 228 in the jaw 24 and the corresponding recess 226 in the portion 36 of the retainer 32.

The operation of the adjustable socket 10 is described in detail with respect to FIGS. 1-6.

The user clamps the rotatable member 18 between his thumb and index finger, and then rotates the rotatable member 18 in a first direction. In another embodiment, any other method can be used to grab the rotatable member 18. As noted above, the rotatable member 18 is threaded onto the housing 12 and is connected to the adjusting collar 20 through a snap-fit arrangement between the circumferential groove 154 disposed on the adjusting collar 20 and the circumferential protrusion 158 formed on the rotatable member 18. Also, as noted above, in another embodiment, the rotatable member 18 is connected to the adjusting collar 20 using a retaining ring design.

As the rotatable member 18 is turned or rotated in the first direction, it causes the housing 12 connected thereto to move upwardly along the anti-rotation portions 602 of the adjusting collar 20. This upward movement of the housing 12 causes the beveled outward surfaces 28 of the jaws 24 to move upwardly against the beveled surface 22 of the adjusting collar 20 so as to overcome the biasing force of the biasing elements 30. This relative movement between the beveled surface 22 of the adjusting collar 20 and the beveled surface 28 of the jaws 24 causes the jaws 24 to move radially inwardly and engage with a surface of a bolt head or a nut (to be engaged by the socket—not shown) disposed between the inward faces 26 of the jaws 24.

To open the jaws 24, the user clamps the rotatable member 18 between his thumb and index finger, and then rotates the rotatable member 18 in a second direction (i.e., opposite to the first direction). As noted above, in another embodiment, any other method can be used to grab the rotatable member 18.

As the rotatable member 18 is turned or rotated in the second direction, it causes the housing 12 connected thereto to move downwardly along the anti-rotation portions 602 of the adjusting collar 20. This downward movement of the housing 12 causes the biasing elements 30 to move the jaws 24 radially outwardly. In one embodiment, the jaws 24 are moved radially outwardly so as to release the surface of a bolt head or a nut (to be engaged by the socket—not shown) disposed between the inward faces 26 of the jaws 24. In another embodiment, the jaws 24 are moved radially outwardly so as to engage with a bolt head or a nut having a different (larger) size.

That is, the rotation of the rotatable member 18 around the housing 12 (in the second and first direction) causes the housing 12 to move upwardly or downwardly inside the adjusting collar 20. As explained above, this upward movement and downward movement of the housing 12 causes the jaws 24 to move radially inwardly or outwardly so as to engage with a bolt head or a nut.

The adjustable socket 10 described in the embodiments above (with respect to FIGS. 1-6) may be used with any ratchet mechanism/wrench.

Figure 7:
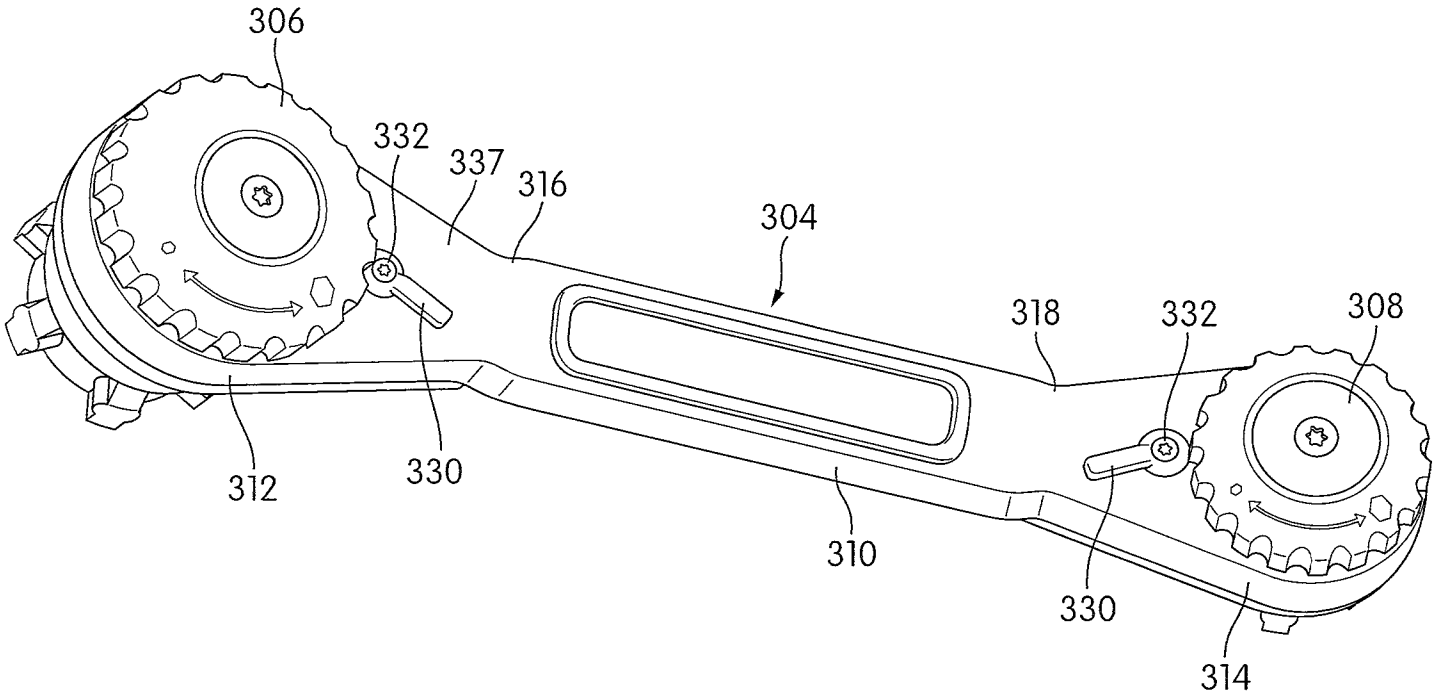
FIG. 7 shows a perspective view of a ratcheting wrench using two different sized exemplary adjustable sockets in accordance with an embodiment of the present patent application.
Figure 8:
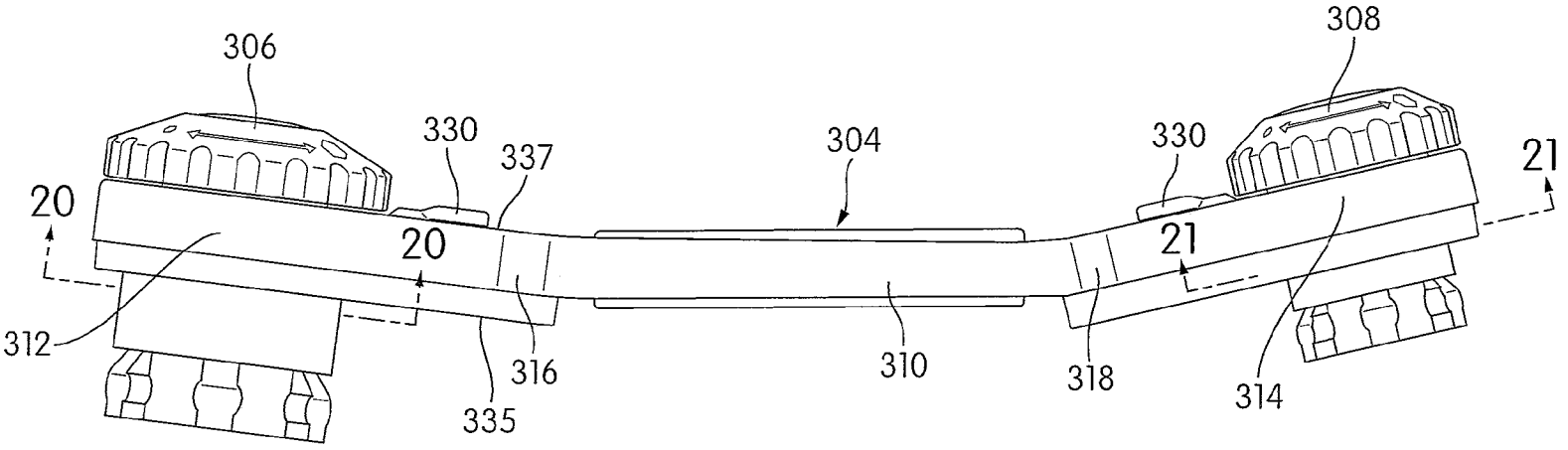
FIG. 8 shows a side view of the ratcheting wrench of FIG. 7 in accordance with an embodiment of the present patent application.
Figure 9:
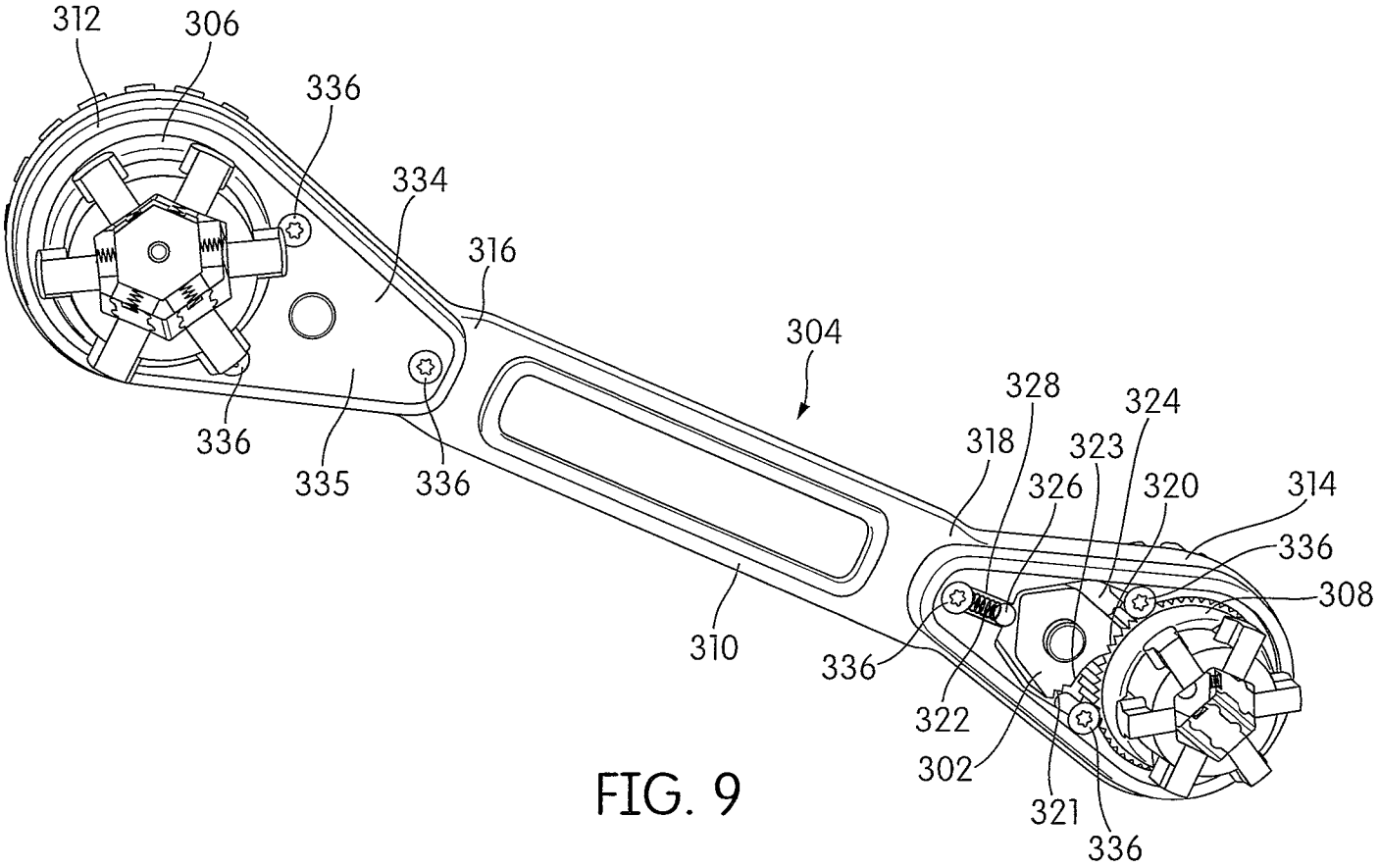
FIG. 9 shows a bottom perspective view of the ratcheting wrench using two exemplary adjustable sockets, with some of its components removed for the sake of clarity, in accordance with an embodiment of the present patent application.
Figure 10:
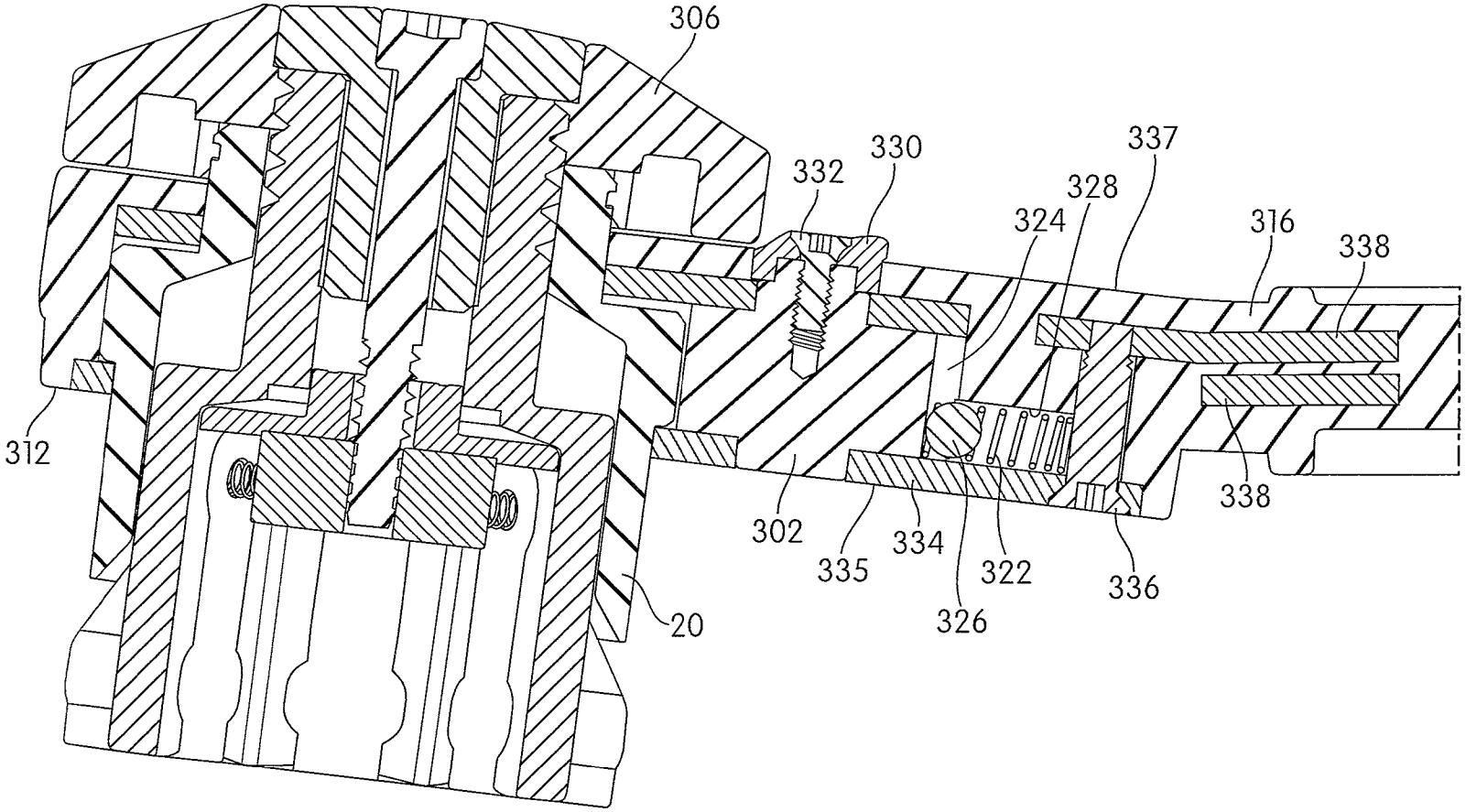
FIG. 10 shows a partial cross-section view of the ratcheting wrench and its large-sized adjustable socket in accordance with an embodiment of the present patent application.
Figure 12:
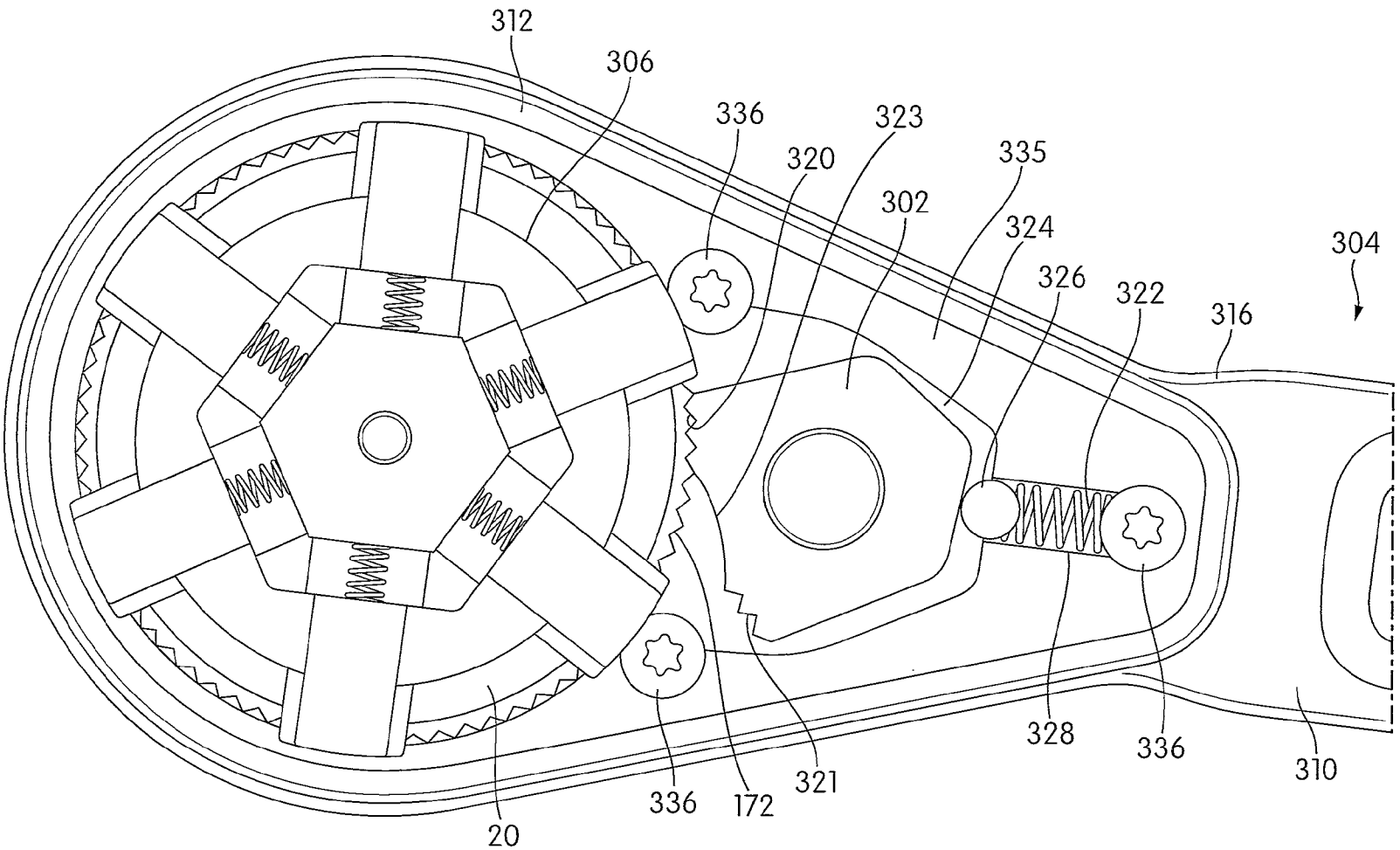
FIG. 12 shows a partial bottom view of the ratcheting wrench and its large-sized adjustable socket, with some of its components removed for the sake of clarity, in accordance with an embodiment of the present patent application.

FIGS. 7-12 show an exemplary ratcheting wrench 304 using two such exemplary adjustable sockets 10 in accordance with an embodiment of the present patent application. Specifically, FIG. 7 shows a perspective view of the exemplary ratcheting wrench 304, while FIGS. 8 and 9 show a side view and a bottom perspective view of the exemplary ratcheting wrench 304, respectively, in accordance with an embodiment of the present patent application. FIGS. 10-12 show a partial cross-section view, a partial bottom perspective view, and a partial bottom view of the exemplary ratcheting wrench 304 and one of its adjustable sockets 306, respectively, in accordance with an embodiment of the present patent application. FIGS. 11-12 have components removed for sake of clarity.

The ratcheting wrench 304 generally includes a handle portion 310 that is constructed and arranged to be manually grasped. The handle portion 310 includes opposing end portions 312 and 314. In one embodiment, the handle portion 310 is made of a plastic material. In another embodiment, the handle portion 310 is made of a composite plastic material. In yet another embodiment, the handle portion 310 may be a one piece forging made of a ferrous material or a nonferrous material.

In one embodiment, the handle portion 310 has bent portions thereon for ergonomics. Specifically, as shown in FIG. 8, the handle portion 310 includes bent portions 316 and 318 that are constructed and arranged to provide leverage and reduce stress on user's arm through proper alignment of the handle portion 310 with the user's arm (e.g., during the operation of the wrench). That is, during the operation of the wrench, as the force is applied horizontally in the same direction as user's wrist, these bent portions 316 and 318 of the handle portion 310 provide an ergonomical alignment of the handle portion 310 with the user's arm.

In the illustrated embodiment of FIGS. 7-12, the ratcheting wrench 304 includes different sized exemplary adjustable sockets disposed at opposing end portions 312 and 314. For example, the ratcheting wrench 304 includes a large-sized adjustable socket 306 disposed at the end portion 312 and a small-sized adjustable socket 308 disposed at the end portion 314, or vice versa. It is contemplated that, in another embodiment, the ratcheting wrench 304 may include same sized adjustable sockets at both the opposing end portions 312 and 314 of the handle portion 310. In yet another embodiment, the ratcheting wrench 304 may include an adjustable socket 10 disposed at one of the opposing end portions 312 and 314 of the handle portion 310 and an integrally formed wrench head disposed at the other of the opposing end portions 312 and 314 of the handle portion 310. The adjustable socket 10 described in the embodiments above (with respect to FIGS. 1-6) may be used with any ratchet mechanism/wrench as would be appreciated by one skilled in the art.

Referring to FIGS. 9-12, the ratchet wrench 304 includes a spring loaded pawl 302 that is constructed and arranged to be adjusted so as to allow the adjustable socket 10 of the present patent application to ratchet in either clockwise or counter-clockwise direction.

As the pawl arrangement for the large-sized adjustable socket 306 has basically the same configuration and operation as that of the pawl arrangement for the small-sized adjustable socket 308, only one such pawl arrangement is described in detail here.

The spring loaded pawl 302 includes gear engaging teeth sets 320 and 321. The pawl 302 is received in a pawl receiving portion 324 in the wrench body 304. As shown in FIGS. 9-12, a biasing element or spring 322 and its ball 326 are disposed in a bore 328 in the wrench body 304. In the illustrated embodiment of FIGS. 9, 11 and 12, the pawl 302 has a pentagon-like shape with the gear engaging teeth sets 320 and 321 being disposed on its base. However, it is contemplated that the pawl 302 may have other shaped configurations as would be appreciated by one skilled in the art. For example, in one embodiment, the pawl may have a generally crescent shaped configuration with a concave surface and a convex surface, where the gear engaging teeth of the pawl are disposed on the concave surface thereof.

The pawl 302 also includes an arcuate shaped clearance portion 323 between the gear engaging teeth sets 320 and 321 that is constructed and arranged to provide clearance for the gear teeth 172 disposed on the adjusting collar 20.

The biasing element 322 (and the pressure of the ball 326) urges the pawl 302 into engagement with the gear teeth 172 disposed on the adjusting collar 20 such that one of the gear engaging teeth sets 320 and 321 thereof engages the gear teeth 172.

The pawl 302 is constructed and arranged to be adjusted through the handle 304 to allow the adjustable socket 10 to ratchet in either the clockwise or counterclockwise direction. Referring to FIGS. 7 and 8, the ratchet body 304 includes ratchet switch members 330 associated with their corresponding pawls 302. As the ratchet switch member for the large-sized adjustable socket 306 has basically the same configuration and operation as that of the ratchet switch member for the small-sized adjustable socket 308, only one such ratchet switch member is described in detail here.

The ratchet switch member 330 is constructed and arranged to be attached with the pawl 302 using a fastener 332 (see, FIGS. 7 and 10). The ratchet switch member 330 is constructed and arranged to be movable between a first position and a second position to facilitate one-way rotational motion (i.e., in a clock-wise or counter-clock wise direction) of the adjustable socket 10. When the ratchet switch member 330 is positioned in the first position, one of the gear engaging teeth sets 320 and 321 of the pawl 302 is configured to engage with the gear teeth 172 disposed on the adjusting collar 20 to permit a first direction of rotation of the adjusting collar 20. When the ratchet switch member 330 is positioned in the second position, the other of the gear engaging teeth sets 320 and 321 of the pawl 302 is configured to engage with the gear teeth 172 disposed on the adjusting collar 20 to permit a second direction of rotation of the adjusting collar 20. The first rotational direction is opposite to the second rotational direction. In another embodiment, the ratchet switch member 330 is constructed and arranged to be positioned in up to three different positions, for example, a first position, a second position, and a third or locked ratcheting position. As clear from the discussions above, when the ratchet switch member 330 is positioned in the first and the second position, it is configured to enable rotation of the adjusting collar in a first direction and a second direction (opposite to the first direction), respectively. In one embodiment, when the ratchet switch is in the third or locked ratcheting position, the ratchet switch member 330 is configured to enable the gear engaging teeth of the pawl to lock-in with the gear teeth disposed on the adjusting collar so that the ratchet cannot turn in either a clockwise or a counterclockwise direction. In such an embodiment, when the ratchet switch member 330 is in the locked ratcheting position, the user may have to manually tighten or loosen a bolt or screw.

The ratchet switch member 330 is one exemplary arrangement that is constructed and arranged to facilitate one-way rotational motion of the adjustable socket 10. It is contemplated that any other arrangement that is constructed and arranged to facilitate one-way rotational motion of the adjustable socket 10 may be used in the present patent application. In yet another embodiment, non-reversible or one-directional ratchet mechanisms may also be used with the adjustable socket 10 of the present patent application.

Referring to FIG. 9, cover plate 334 is secured to the ratchet body 304 using fasteners 336. In FIG. 9, the cover plate for the small-sized adjustable socket 308 has been removed to clearly show the pawl arrangement disposed under it. Similarly, in FIGS. 11 and 12, the cover plate for the large-sized adjustable socket 306 has been removed to clearly show the pawl arrangement disposed under it. In one embodiment, the cover plate 334 and the ratchet switch member 330 are disposed on opposing sides of the ratchet body 304. That is, the cover plate 334 is disposed on a bottom side 335 of the ratchet body 304, while the ratchet switch member 330 is disposed on atop side 337 of the ratchet body 304.

In one embodiment, referring to FIG. 10, insert plates 338 are molded into the plastic ratchet body 304 in order to provide strength. In one embodiment, the insert plates 338 are made of a steel material.

As the wrench body 304 is manually moved in a direction to apply torque to the adjustable socket 10 and to the bolt head or nut disposed therein, one of the gear engaging teeth sets 320 and 321 of the pawl 302 engage the gear teeth 172 of the adjusting collar 20 so that movement of the wrench body 304 is applied as torque to the adjusting collar 20. This in turn is transmitted to the jaws 24 and to the bolt head or nut disposed therein.

As the wrench body 304 is moved in the opposite direction, the pawl teeth 320 or 321 disengage from and ride over the gear teeth 172 disposed on the adjusting collar 20 against the bias of the biasing element 322 so that the other of the gear engaging teeth sets 320 and 321 of the pawl 302 engages the gear teeth 172 of the adjusting collar 20.

Figure 13:
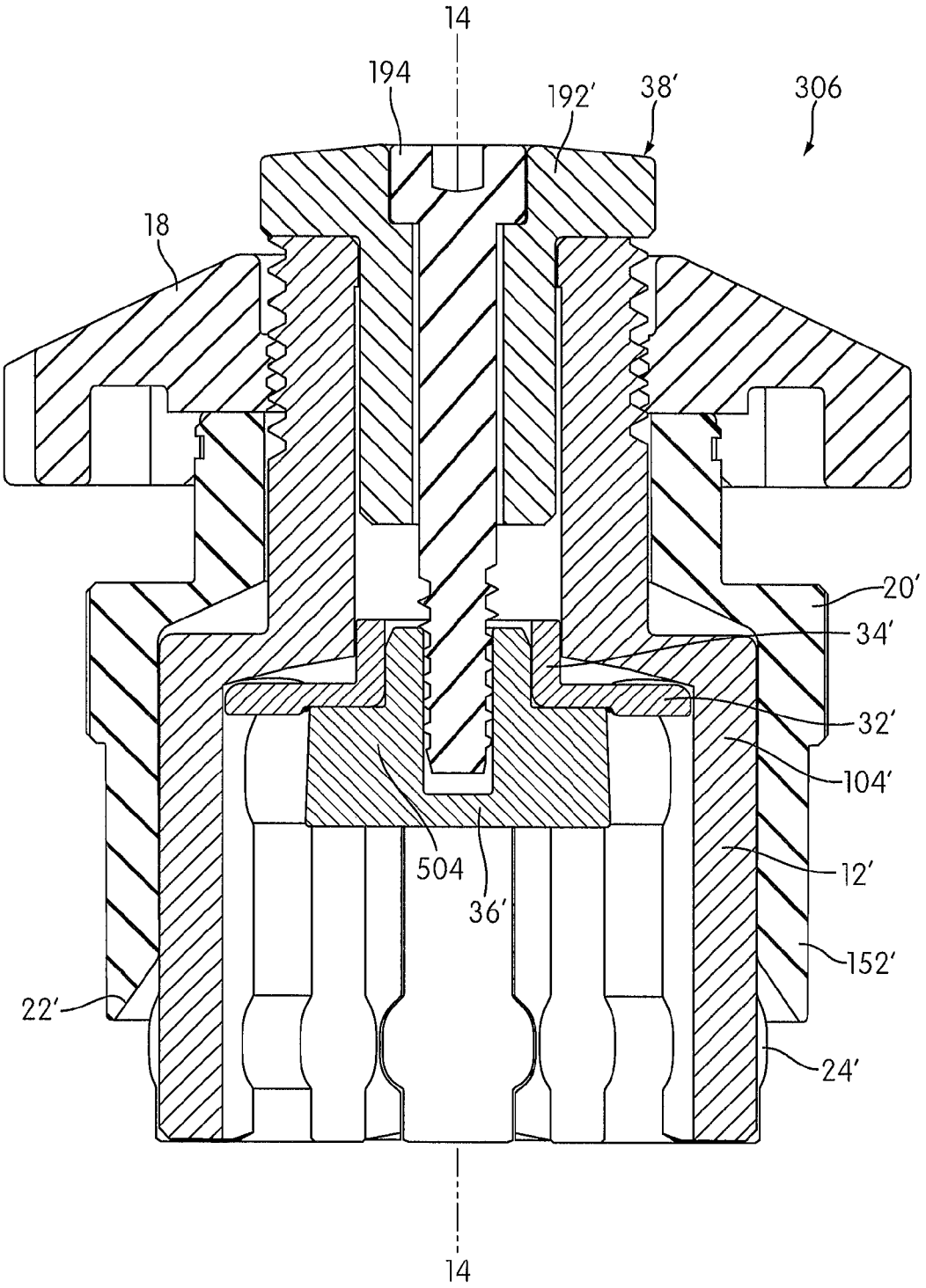
FIGS. 13 and 14 show cross-section views of the large-sized adjustable socket of the ratcheting wrench in accordance with an embodiment of the present patent application.

FIGS. 13-15 show different views of the large-sized adjustable socket 306. Specifically, FIGS. 13 and 14 show cross-section views of the large-sized adjustable socket 306, while FIG. 15 shows a detailed cross-section view of a portion of the large-sized adjustable socket 306 in accordance with an embodiment of the present patent application.

The operation of the large-sized adjustable socket 306 is same as that of the adjustable socket 10 described with respect to FIGS. 1-6, therefore, the operation of the large-sized adjustable socket 306 will not be described here again. The configuration of the large-sized adjustable socket 306 is same as that of the adjustable socket 10 described with respect to FIGS. 1-6, except for some difference as noted below.

The lower portion 104' of the housing 12' has a diameter that is larger than the diameter of the lower portion 104 of the housing 12 of the adjustable socket 10. The lower portion 152' of the adjusting collar 20' has a diameter that is larger than the diameter of the lower portion 152 of the adjusting collar 20 of the adjustable socket 10. The lower portion 104' and the lower portion 152' of the large-sized adjustable socket 306 are sized, shaped and constructed such that the jaws 24' of the large-sized adjustable socket 306 receive and engage with a larger-sized bolt head or a larger-sized nut (i.e., than those received by the adjustable socket 10). In one embodiment, the jaws 24' of the large-sized adjustable socket 306 are different in size and construction from the jaws 24 of the small-sized adjustable socket 308 that is described with respect to FIGS. 16-19.

The flange portion 34' of the retainer 32' has a diameter that is larger than the diameter of the flange portion 34 of the retainer 32 of the adjustable socket 10. In one embodiment, the height of the first lock member 192' is same as the height of the first lock member 192 of the adjustable socket 10. In another embodiment, the height of the first lock member 192' is different from the height of the first lock member 192 of the adjustable socket 10. In one embodiment, the height of the first lock member 192' is used to accommodate the change in overall length (lower or upper portion) of the housing 12'. In one embodiment, the length of each biasing element 30' is same as the length of the biasing element 30 of the adjustable socket 10. In another embodiment, the length of each biasing element 30' is different from the length of the biasing element 30 of the adjustable socket 10.

In one embodiment, the changes in diameter of the flange portion 34' of the retainer 32' is used to accommodate the change in diameter of the lower portion 104' of the housing 12'. In one embodiment, the diameter of the first lock member 192' may be different than the diameter of the first lock member 192 of adjustable socket 10 and the change in diameter may be used to accommodate the change in diameter of the upper portion 102' of the housing 12'. In one embodiment, the first lock member 192 does not reach the lower portion 104 of the housing 12. In another embodiment, as noted above, the height of the first lock member 192' and the length of the biasing element 30' remain the same in both the large-sized adjustable socket 306 and the small-sized adjustable socket 308.

The flange portion 34' of the retainer 32' includes a circumferential receiving portion 502 protruding downwardly from the flange portion 34'. The circumferential receiving portion 502 is configured to receive a portion 504 of the hexagonal shaped portion 36' so as to secure the flange portion 34' to the hexagonal shaped portion 36'. In another embodiment, the portion 36' may have other shaped configurations as would be appreciated by one skilled in the art.

FIG. 13 shows the large-sized adjustable socket 306 when its housing 12' is moved upwardly along the longitudinal axis 14 (caused by the rotation of the rotatable member 18).

The rotation of the rotatable member 18 causes the housing 12' to move upwardly. When the housing 12' is moved upwardly, the beveled surface 22' of the adjusting collar 20' is pushed against the beveled surface 28' of the jaws 24'. This relative movement between the beveled surface 22' of the adjusting collar 20' and the beveled surface 28' of the jaws 24' causes the jaws 24' to move radially inwardly.

FIG. 14 shows the large-sized adjustable socket 306 when its housing 12' is moved downwardly along the longitudinal axis 14 (caused by the rotation of the rotatable member 18). As can be seen from FIG. 14, the housing 12' moves downwardly along the anti-rotation portions of the adjusting collar 20'. This downward movement of the housing 12' causes the biasing elements 30' to move the jaws 24' radially outwardly.

Figure 17:
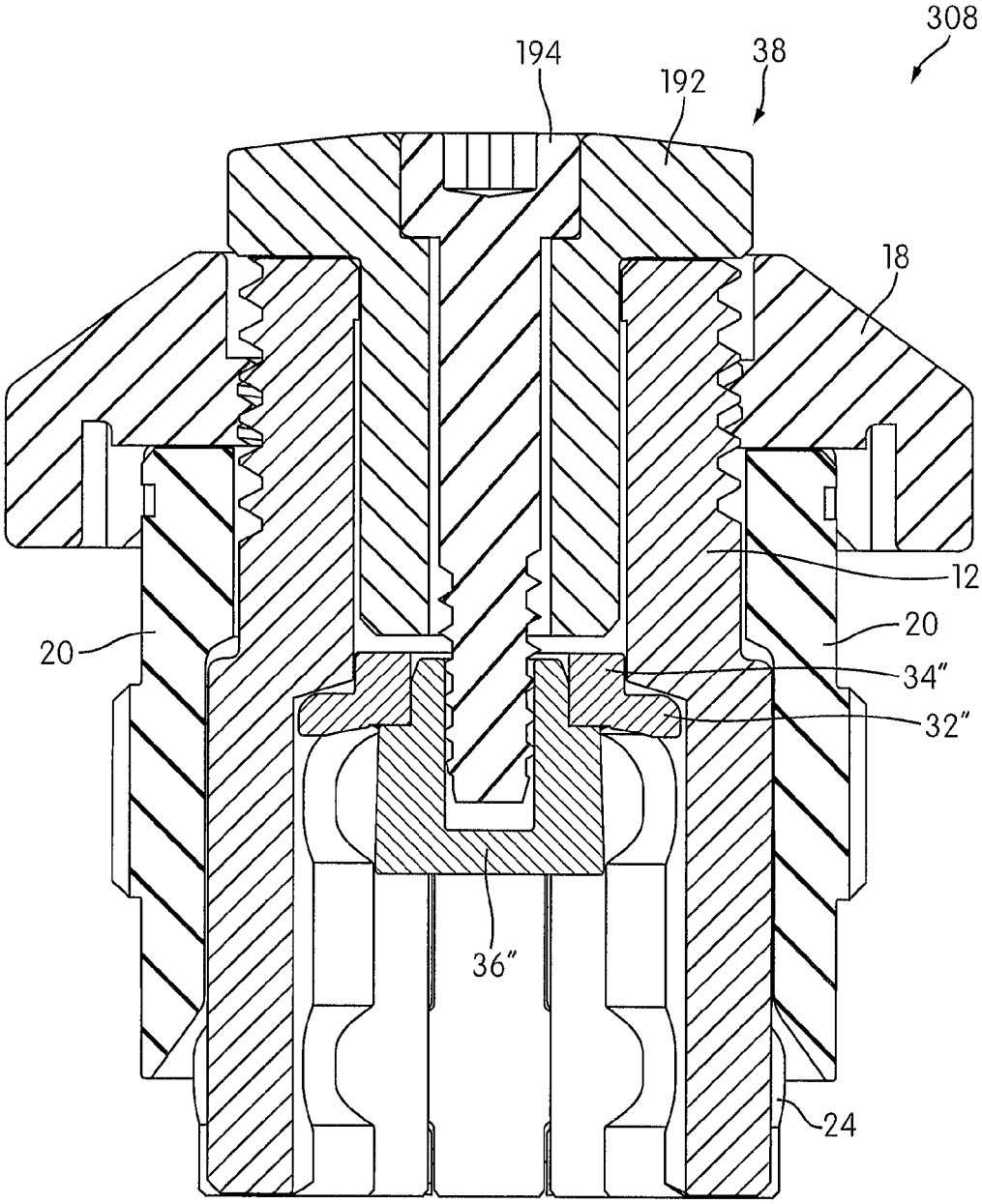

FIGS. 16-19 show different views of the small-sized adjustable socket 308. Specifically, FIGS. 16-18 show cross-section views of the small-sized adjustable socket 308, while FIG. 19 shows a detailed cross-section view of a portion of the small-sized adjustable socket 308 in accordance with an embodiment of the present patent application.

The operation of the small-sized adjustable socket 308 is same as that of the adjustable socket 10 described with respect to FIGS. 1-6, therefore, the operation of the small-sized adjustable socket 308 will not be described here again. The configuration of the small-sized adjustable socket 308 is same as that of the adjustable socket 10 described with respect to FIGS. 1-6, except for some difference as noted below.

The flange portion 34" of the retainer 32" includes a circumferential receiving portion 502' protruding downwardly from the flange portion 34'. The circumferential receiving portion 502' is configured to receive a portion 504' of the hexagonal shaped portion 36" so as to secure the flange portion 34" to the hexagonal shaped portion 36". In another embodiment, the portion 36" may have other shaped configurations as would be appreciated by one skilled in the art.

FIG. 16 shown a cross-section view of the small-sized adjustable socket 308, where the lock member is removed for sake of clarity. FIG. 17 shows the small-sized adjustable socket 308 when the housing 12 is moved upwardly along its adjusting collar 20 (caused by the rotation of its rotatable member 18). In one embodiment, the rotatable member 18 of the large-sized adjustable socket 306 is different from the rotatable member 18 of the small-sized adjustable socket 308.

The rotation of the rotatable member 18 causes the housing 12 to move upwardly. When the housing 12 is moved upwardly, the beveled surface 22 of the adjusting collar 20 is pushed against the beveled surface 28 of the jaws 24. This relative movement between the beveled surface 22 of the adjusting collar 20 and the beveled surface 28 of the jaws 24 causes the jaws 24 to move radially inwardly.

FIG. 18 shows the small-sized adjustable socket 308 when its housing 12 is moved downwardly along the adjusting collar 20 (caused by the rotation of the rotatable member 18). As can be seen from FIG. 18, the relative movement between the beveled surface 22 of the adjusting collar 20 and the beveled surface 28 of the jaws 24 causes the biasing elements 30 to move the jaws 24 radially outwardly.

FIGS. 20 and 21 show bottom cross-section views of the large-sized adjustable socket and the small-sized adjustable socket, respectively, taken along cross-sectional planes/lines 20-20 and 21-21 in FIG. 8, respectively.

The adjustable socket of the present patent application may be used by a user to adjust the adjustable socket to fit multiple fastener sizes without the need to change sockets.

Although the present patent application has been described in detail for the purpose of illustration based on what is currently considered to be the most practical and preferred embodiments, it is to be understood that such detail is solely for that purpose and that the present patent application is not limited to the disclosed embodiments, but, on the contrary, is intended to cover modifications and equivalent arrangements that are within the spirit and scope of the appended claims. For example, it is to be understood that the present patent application contemplates that, to the extent possible, one or more features of any embodiment can be combined with one or more features of any other embodiment.

What is claimed is:

1. An adjustable socket comprising:

a housing having a longitudinal axis, the housing having a plurality of apertures extending therethrough;

a rotatable member engageable with the housing such that the rotation of the rotatable member causes the housing to move upwardly or downwardly along the longitudinal axis;

an adjusting collar engageable with the rotatable member and the housing, the adjusting collar having a beveled surface;

a plurality of jaws, each jaw being received in a corresponding one of the apertures, each jaw having:

an inward face facing towards the longitudinal axis of the housing;

a beveled outward face facing away from the longitudinal axis of the housing, the beveled outward face being slidable on the beveled surface of the adjusting collar; and a biasing element biasing the each jaw away from the longitudinal axis of the housing;

a retainer having a flange supportable by the housing and a protrusion extending from the flange between the jaws' inward faces, each biasing element extending between the protrusion and a corresponding one of the jaws; and a lock member operatively connected with the rotatable member and constructed and arranged to secure the adjusting collar to the housing and the plurality of jaws;

wherein the jaws are movable towards and away from the longitudinal axis of the housing through a range of positions upon the rotation of the rotatable member, and wherein the rotatable member is constructed and arranged to be movable relative to the adjusting collar to facilitate the movement of jaws towards and away from the longitudinal axis of the housing.

2. The adjustable socket of claim 1, wherein the adjusting collar and the rotatable member are connected to each other using a snap-fit arrangement.

3. The adjustable socket of claim 1, wherein the lock member is constructed and arranged to pass through apertures of the rotatable member, the housing, and the retainer for holding them together in an assembled configuration.

4. The adjustable socket of claim 1, further comprising an externally threaded portion disposed on the housing that is constructed and arranged to engage with an internally threaded portion of the rotatable member so as to secure the rotatable member to the housing.

5. The adjustable socket of claim 1, wherein the adjusting collar includes gear teeth disposed on at least an external surface portion thereon.

6. The adjustable socket of claim 5, wherein the gear teeth are constructed and arranged to engage with a pawl of a ratchet wrench mechanism so as to allow the adjustable socket to ratchet in either a clockwise or a counter-clockwise direction.

7. The adjustable socket of claim 1, wherein each jaw includes a pair of opposing protrusions that are constructed and arranged to be received in a pair of opposing grooves formed in its corresponding aperture, when the jaw is received in its corresponding aperture so as to secure the jaw in its corresponding aperture and also permit movement of the jaw in its corresponding aperture.

8. The adjustable socket of claim 1, wherein the adjusting collar and the rotatable member are connected to each other using a retaining ring arrangement.

9. The adjustable socket of claim 1, further comprising an anti-rotation portion disposed on the adjusting collar, on the housing, or both, wherein the anti-rotation portion is constructed and arranged to navigate the housing move upwardly or downwardly along the longitudinal axis.

10. The adjustable socket of claim 9, wherein the anti-rotation portion is constructed and arranged to maintain proper orientation between the adjusting collar and the housing and to prevent the housing from rotating about the longitudinal axis.

11. The adjustable socket of claim 1, wherein the rotatable member does not cause the adjusting collar to rotate with the rotatable member about the longitudinal axis of the housing.

12. The adjustable socket of claim 1, wherein the rotatable member is constructed and arranged to be rotatable relative to the adjusting collar to facilitate the movement of jaws towards and away from the longitudinal axis of the housing.

13. An adjustable ratchet socket wrench comprising:

a body;

at least one pawl arrangement disposed in the body; and at least one adjustable socket comprising:

a housing having a longitudinal axis, the housing having a plurality of apertures extending therethrough;

a rotatable member engageable with the housing such that the rotation of the rotatable member causes the housing to move upwardly or downwardly along the longitudinal axis;

an adjusting collar engageable with the rotatable member and the housing;

a plurality of jaws, each jaw being received in a corresponding one of the apertures, each jaw having:

an inward face facing towards the longitudinal axis of the housing;

a beveled outward face facing away from the longitudinal axis of the housing, the beveled outward face being slidable on the beveled surface of the adjusting collar; and a biasing element biasing the each jaw away from the longitudinal axis of the housing;

a retainer having a flange supportable by the housing and a protrusion extending from the flange between the jaws' inward faces, each biasing element extending between the protrusion and a corresponding one of the jaws; and a lock member operatively connected with the rotatable member and constructed and arranged to secure the adjusting collar to the housing and the plurality of jaws;

wherein the jaws are movable towards and away from the longitudinal axis of the housing through a range of positions upon the rotation of the rotatable member, wherein the adjusting collar comprising gear teeth disposed on an external surface portion thereon, wherein the gear teeth on the adjusting collar are constructed and arranged to engage with a pawl of the at least one pawl arrangement so as to allow the adjustable socket to ratchet in either clockwise or counter-clockwise direction, and wherein the rotatable member is constructed and arranged to be movable relative to the adjusting collar to facilitate the movement of jaws towards and away from the longitudinal axis of the housing.

14. The adjustable ratchet socket wrench of claim 13, further comprising a handle portion, and wherein the body and the handle portion are made from a composite plastic material or a nonferrous metal material.

15. The adjustable ratchet socket wrench of claim 13, wherein the pawl has a pentagon shaped configuration and includes a first and a second set of gear engaging teeth disposed on a base of the pentagon shaped pawl.

16. The adjustable ratchet socket wrench of claim 15, wherein the handle portion includes bent portions that are constructed and arranged to provide improved comfort and ergonomics to the user.

17. The adjustable ratchet socket wrench of claim 15, wherein the adjusting collar does not rotate with the rotatable member unless the adjusting collar is used with the wrench.

18. The adjustable ratchet socket wrench of claim 15, further comprising a ratchet switch member constructed and arranged to be attached to the pawl and to be movable between a first position and a second position to facilitate one-way rotational motion of the adjustable socket.

19. The adjustable ratchet socket wrench of claim 18, wherein, when the ratchet switch member is positioned in the first position, the one of the gear engaging teeth sets of the pawl is configured to engage with the gear teeth disposed on the adjusting collar to permit a first direction of rotation of the adjusting collar, wherein, when the ratchet switch member is positioned in the second position, the other of the gear engaging teeth sets of the pawl is configured to engage with the gear teeth disposed on the adjusting collar to permit a second direction of rotation of the adjusting collar, and wherein the first direction of rotation is opposite to the second direction of rotation.

20. The adjustable ratchet socket wrench of claim 19, wherein, when the adjusting collar is rotating in either the first direction of rotation or the second direction of rotation, the housing is rotatable along with and in the same direction as the adjusting collar.

* * * * *